US010563341B2

(12) United States Patent
Lee et al.

(10) Patent No.: US 10,563,341 B2
(45) Date of Patent: Feb. 18, 2020

(54) CLOTHING DRYER

(71) Applicant: Samsung Electronics Co., Ltd., Gyeonggi-do (KR)

(72) Inventors: Dong Jun Lee, Gwangju (KR); Koang Hun Ryu, Gwangju (KR); Dong-Pil Seo, Gyeonggi-do (KR); Ok Hwan Jang, Gwangju (KR); Young Chul Jo, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 563 days.

(21) Appl. No.: 15/040,903

(22) Filed: Feb. 10, 2016

(65) Prior Publication Data

US 2016/0230330 A1 Aug. 11, 2016

(30) Foreign Application Priority Data

Feb. 10, 2015 (KR) ..... 10-2015-0020334

(51) Int. Cl.
*D06F 58/20* (2006.01)

(52) U.S. Cl.
CPC ..... *D06F 58/20* (2013.01)

(58) Field of Classification Search
CPC ..... D06F 58/20; D06F 58/04; D06F 39/14; E05C 3/124; E05C 19/12
See application file for complete search history.

(56) References Cited

U.S. PATENT DOCUMENTS

2004/0111916 A1 6/2004 Hwang
2006/0059711 A1* 3/2006 Kim ..... D06F 39/14 34/603
2009/0167126 A1 7/2009 Yoon
2014/0042881 A1* 2/2014 Brown ..... D06F 37/42 312/222
2015/0215897 A1 7/2015 Jang et al.

FOREIGN PATENT DOCUMENTS

KR 10-2013-0019363 A 2/2013
KR 10-1409958 B1 6/2014

OTHER PUBLICATIONS

Extended European Search Report dated Jun. 6, 2016 in connection with European Patent Application No. 16154180.0; 9 pages.

* cited by examiner

*Primary Examiner* — Jessica Yuen

(57) ABSTRACT

Disclosed herein is a clothing dryer in which a structure of a door locking device is improved and a door is detachable from a main body. The clothing dryer includes a main body including a coupling hole formed in a front surface thereof, a drying drum installed inside the main body and including an opening formed in a front surface thereof, a door, and a door locking device coupled to the coupling hole and installed in the main body so that the engaging member is detachable from the main body, and the door locking device includes a body unit, a locking unit disposed inside the body unit and from which the engaging member is detachable, and a restoring member which is provided between the body unit and the coupling hole, supports the body unit, and includes a restoring force.

20 Claims, 21 Drawing Sheets

CLOTHING DRYER

CROSS-REFERENCE TO RELATED APPLICATION(S) AND CLAIM OF PRIORITY

The present application is related to and claims benefit of Korean Patent Application No. 10-2015-0020334, filed on Feb. 10, 2015 in the Korean Intellectual Property Office, the disclosure of which is incorporated herein by reference.

TECHNICAL FIELD

Embodiments of the present disclosure relate to a clothing dryer in which a structure of a door locking device is improved and a door is detachable from a main body.

BACKGROUND

In general, a clothing dryer, which dries wet laundry introduced into a drying drum by forcing hot air into the drying drum, dries the laundry by being forced to circulate the hot air heated by a heater and a blowing fan to the drying drum.

The clothing dryer includes a main body having a door provided on a front surface thereof, a drying drum installed in a cylindrical shape which extends in a front-rear direction in the main body, a hot-air inlet duct, an end of which is installed behind the drying drum, that includes the heater and guides air that has been converted into hot air to the drying drum, a hot-air outlet duct in which the blowing fan is installed and which guides the hot air discharged from the drying drum to be discharged to the outside, and a hot-air guide tube which guides the hot air in the drying drum to the hot-air outlet duct.

In the clothing dryer with the main body and an opening of the drying drum provided on a front thereof and the door coupled to a front surface of the main body to be rotatable, a sagging phenomenon of the door may occur with the passage of time due to the weight of the door. When the sagging phenomenon of the door occurs, in the case in which the door is coupled to the main body while the door is closed, the door and the door locking device installed in the main body may be damaged or the durability of the clothing dryer may be reduced.

SUMMARY

To address the above-discussed deficiencies, it is a primary object to provide a clothing dryer having an improved structure in which a door and a door locking device are prevented from being damaged due to the sagging phenomenon of the door.

Further, it is another aspect of the present disclosure to provide a clothing dryer in which a door locking device having an improved structure and capable of being moved vertically and horizontally while coupled to a main body is included and the durability is improved.

Further, it is still another aspect of the present disclosure to provide a clothing dryer including a door locking device having an improved structure that can be easily coupled to a main body without screwing.

In accordance with one aspect of the present disclosure, a clothing dryer includes a main body comprising a coupling hole formed in a front surface thereof, a drying drum installed inside the main body and comprising an opening formed in a front surface thereof, a door comprising an engaging member provided on a side thereof, and which is coupled to the main body to be rotatable and configured to open and close the opening of the drying drum, and a door locking device coupled to the coupling hole and installed in the main body so that the engaging member is detachable from the main body, and the door locking device includes a body unit, a locking unit disposed inside the body unit and from which the engaging member is detachable, and a restoring member which is provided between the body unit and the coupling hole, supports the body unit, and comprising a restoring force.

The body unit includes a front plate and a rear case installed at a rear surface of the front plate, and the restoring member includes a first lever which extends from a bottom surface of the rear case to the front plate.

The restoring member further includes a first engaging unit protruding downward from a bottom surface of the first lever, and the door locking device further includes a first insertion space provided between the first engaging unit and the front plate for insertion of the main body.

A first hole including a space in which an end of the first lever moves vertically is formed in the front plate.

The restoring member further includes a second lever which extends from an upper surface of the rear case to the front plate.

The restoring member further include a second engaging unit protruding upward from an upper surface of the second lever, and the door locking device further include a second insertion space provided between the second engaging unit and the front plate for insertion of the main body.

A second hole including a space in which an end of the second lever moves vertically is formed in the front plate.

An insertion hole connected to an inside of the rear case is formed in the front plate, and the locking unit is installed at a position facing the insertion hole inside the rear case and include a locking member having an engaging groove from which the engaging member is detachable.

The locking unit further includes a rotating shaft installed inside the rear case so that the locking member is rotatable, and the locking member is provided to move horizontally along the rotating shaft inside the rear case.

The body unit includes a front plate, a rear case installed at a rear surface of the front plate, and an insertion groove provided between the front plate and the rear case for insertion of the main body, and the restoring member is disposed inside the insertion groove.

The locking unit is installed at a position facing the insertion hole inside the rear case and includes a locking member having an engaging groove from which the engaging member is detachable, and the insertion groove is provided under the locking member.

The restoring member is provided as a leaf spring.

The restoring member further includes a third lever which extends from an upper surface of the rear case to the front plate.

The restoring member further includes a third engaging unit protruding upward from an upper surface of the third lever, and a space into which the main body is inserted between the third engaging unit and the front plate is formed in the door locking device.

A third hole including a space in which an end of the third lever moves vertically is formed in the front plate.

The locking unit further includes a rotating shaft installed inside the rear case so that the locking member is rotatable, and the locking member is provided to move horizontally along the rotating shaft inside the rear case.

In accordance with another aspect of the present disclosure, a clothing dryer includes a main body having a coupling hole formed in a front surface thereof, a drying drum installed inside the main body and having an opening formed in a front surface thereof, a door having an engaging member provided on a side thereof, and which is coupled to the main body to be rotatable and opens and closes the opening of the drying drum, and a door locking device coupled to the coupling hole and installed in the main body so that the engaging member is detachable from the main body. The door locking device includes a first fixing unit having a first insertion space into which a lower end of the coupling hole is inserted and a second fixing unit having a second insertion space into which an upper end of the coupling hole is inserted, and at least one of the first fixing unit and the second fixing unit has restoring force.

The door locking device further include a body unit having a front plate and a rear case installed at a rear surface of the front plate, and the first fixing unit include a first lever which extends from a bottom surface of the rear case to the front plate.

The first fixing unit further includes a first engaging unit protruding downward from a bottom surface of the first lever, and the first insertion space is formed between the first engaging unit and the front plate.

A first hole including a space in which an end of the first lever moves vertically is formed in the front plate.

The first lever comprises a restoring force.

The door locking device further includes a body unit having a front plate and a rear case installed at a rear surface of the front plate, and the first insertion space is provided as an insertion groove provided between the front plate and the rear case for insertion of the main body.

The first fixing unit includes a leaf spring disposed inside the insertion groove.

The door locking device further includes a body unit having a front plate and a rear case installed at a rear surface of the front plate, the second fixing unit further includes a third lever which extends from an upper surface of the rear case to the front plate and a third engaging unit protruding upward from an upper surface of the third lever, and the second insertion space is formed between the third engaging unit and the front plate.

In accordance with still another aspect of the present disclosure, a clothing dryer includes a main body having a coupling hole formed in a front surface thereof, a drying drum installed inside the main body and having an opening formed in a front surface thereof, a door having an engaging member provided on a side thereof, and which is coupled to the main body to be rotatable and opens and closes the opening of the drying drum, and a door locking device coupled to the coupling hole and installed in the main body so that the engaging member is detachable from the main body. The door locking device includes a body unit including a front plate and a rear case installed at a rear surface of the front plate, a locking unit disposed inside the body unit and from which the engaging member is detachable, a first lever which extends from a bottom surface of the rear case to the front plate and supports a lower end of the coupling hole, and a second lever which extends from an upper surface of the rear case to the front plate and supports an upper end of the coupling hole, and at least one of the first lever and the second lever has restoring force.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device is implemented in hardware, firmware or software, or some combination of at least two of the same. It should be noted that the functionality associated with any particular controller is centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 21, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. Hereinafter, embodiments of the present disclosure will be described in detail with reference to the accompanying drawings.

Figure 1:
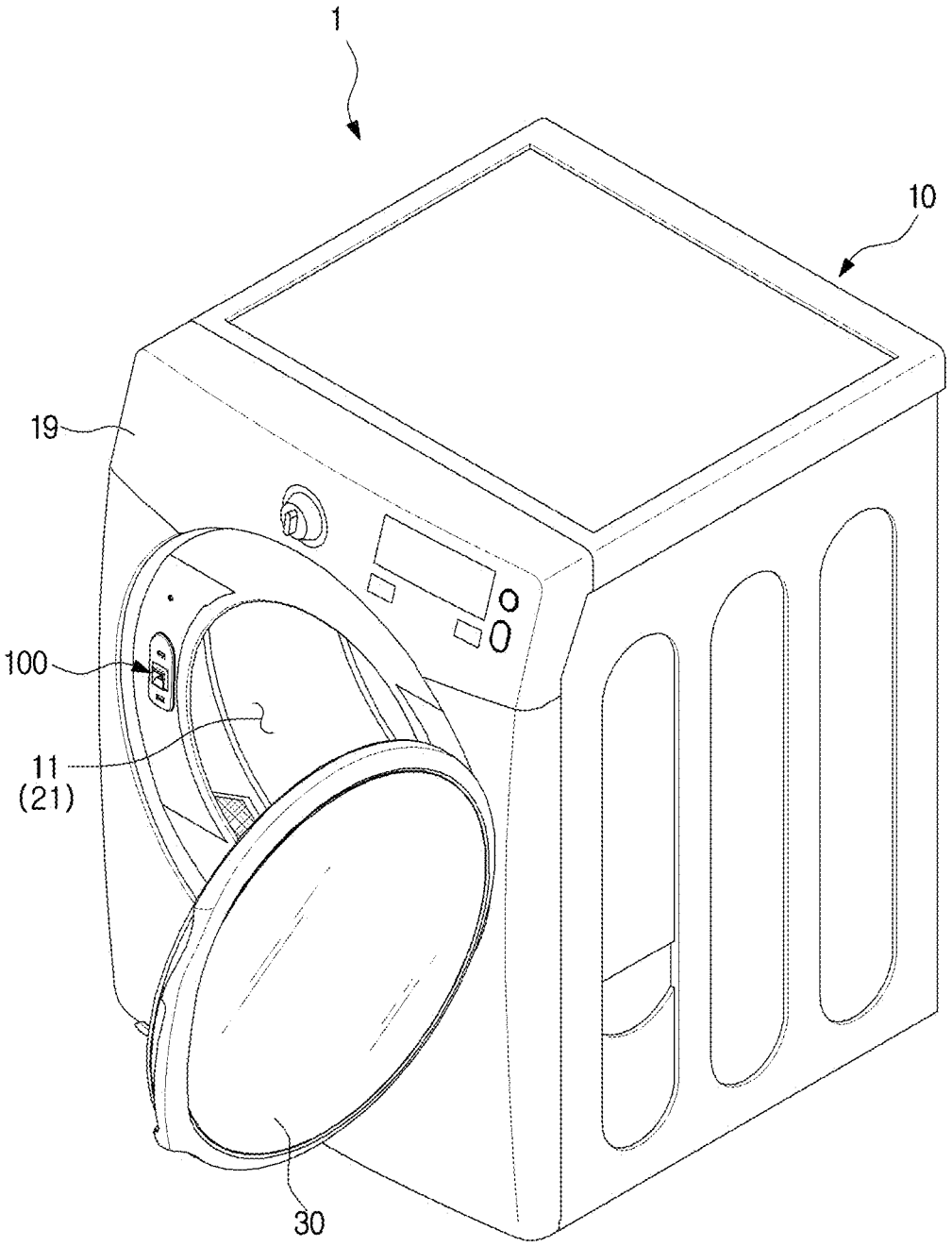
FIG. 1 illustrates a clothing dryer in accordance with various embodiments of the present disclosure.
Figure 2:
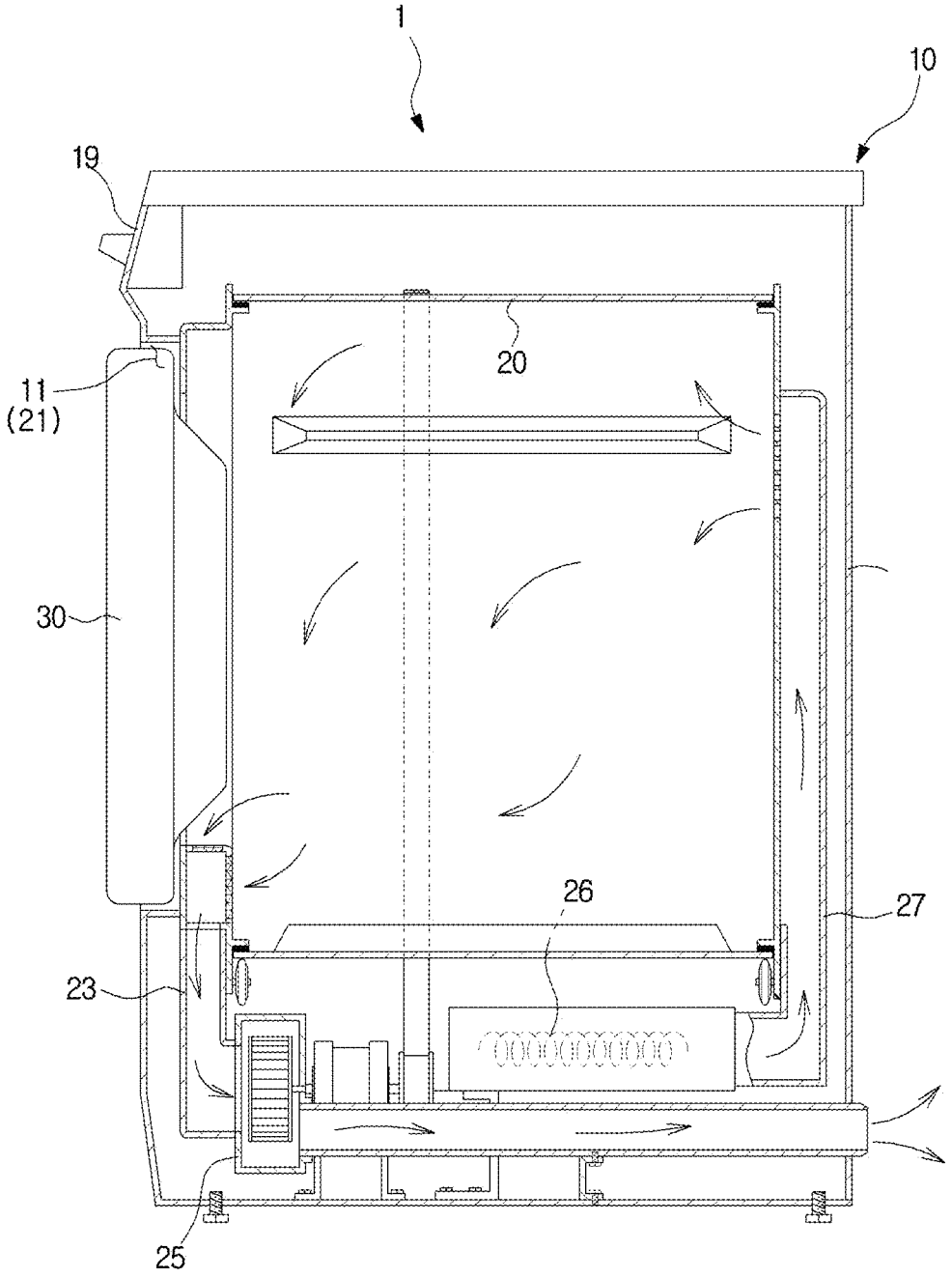
FIG. 2 illustrates a clothing dryer according to various embodiments of the present disclosure.

FIG. 1 is a perspective view schematically illustrating a clothing dryer in accordance with an embodiment of the present disclosure. FIG. 2 is a cross-sectional view schematically illustrating the clothing dryer according to the embodiment of the present disclosure.

Referring to FIGS. 1 and 2, a clothing dryer 1 includes a main body 10 which forms an exterior thereof and a drying drum 20 which is rotatable inside the main body 10 and dries clothes therein.

The main body 10 forms an exterior of the clothing dryer 1. The main body 10 is provided in an approximately hexahedral shape. An opening 11 into which materials to be dried are introduced is formed on the front of the main body 10. A door 30 which opens and closes the opening 11 is installed on one side of the front of the main body 10.

A control panel 19 for controlling operations of the clothing dryer 1 is provided on the upper side of the front surface of the main body 10.

The drying drum 20 having a cylindrical shape is installed inside the main body 10 to receive power of a motor (not illustrated) and to be rotatable. In the drying drum 20, an opening 21 is formed at a position facing the opening 11 of the main body 10. Therefore, when the door 30 is opened, the clothing dryer 1 is provided so that the materials to be dried can be introduced into or discharged from the drying drum 20 through the openings 11 and 21.

An outlet duct 23 and a blowing fan 25, which communicate with an inside of the drying drum 20, are installed under the drying drum 20. A rear of the drying drum 20 is connected to a hot air inlet duct 27 and a heater 26 serving as a source of heat is installed inside the hot air inlet duct 27.

Therefore, the materials to be dried such as wet clothes and the like are introduced into the drying drum 20 through the door 30, and the drying drum 20 and the blowing fan 25 operate when the driving is started through the control panel 19. The drying drum 20 rotates, mixes, and uniformly dries the materials to be dried while being rotated. The air inside the drying drum 20 is discharged to the outside by the blowing fan 25 through the outlet duct 23.

The door 30 is capable of pivoting to one side of the front of the main body 10. When the openings 11 and 21 are closed, the door 30 is coupled to a door locking device 100 provided in the main body 10. Accordingly, the door 30 is provided not to be separated from the main body 10 while the clothing dryer 1 operates.

Hereinafter, the door locking device according to an embodiment of the present disclosure will be described in detail.

Figure 3:
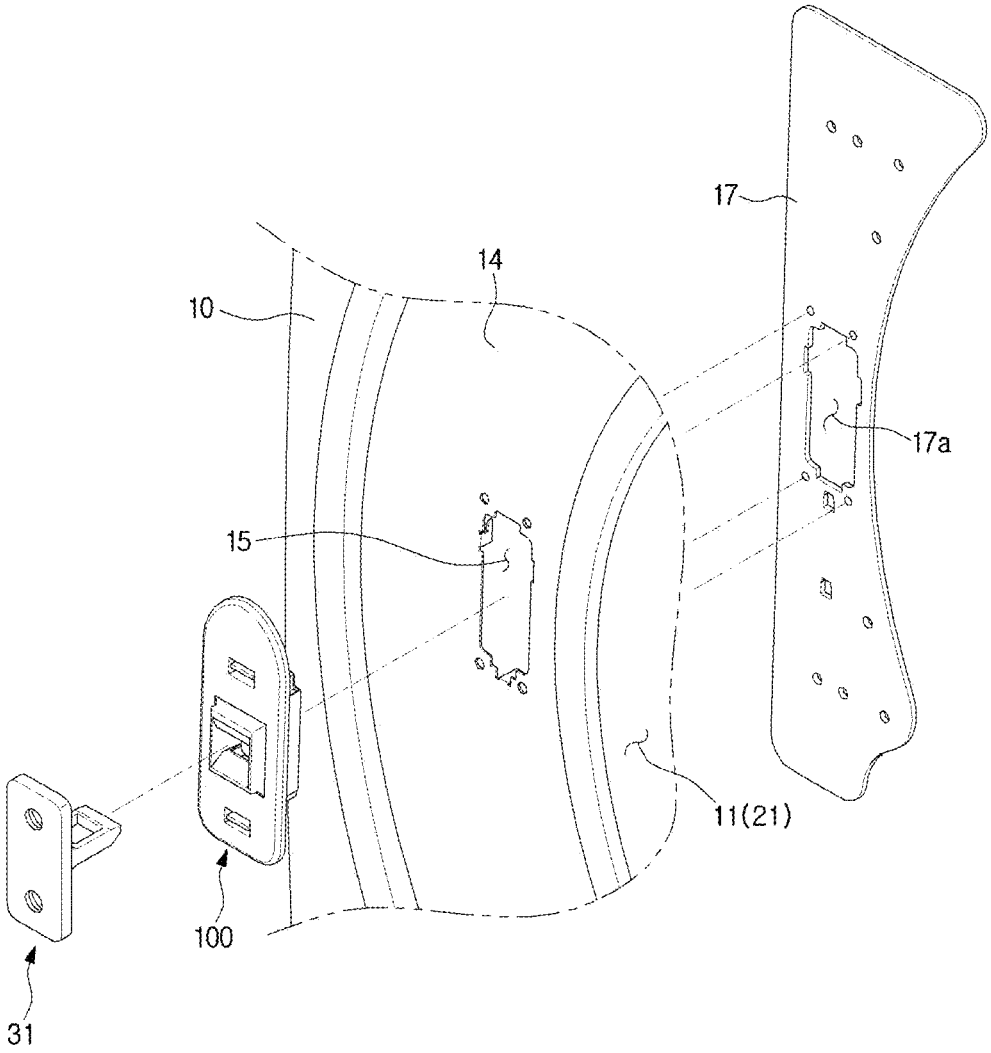
FIG. 3 illustrates a configuration in which a door locking device is coupled to a main body according to various embodiments of the present disclosure.

FIG. 3 is an enlarged view illustrating a configuration in which the door locking device is coupled to the main body according to an embodiment of the present disclosure.

Referring to FIGS. 1 to 3, the door locking device 100 is coupled to a coupling hole 15 provided on one side of the front surface of the main body 10. A door coupling groove 14 is formed on the one side of the front surface of the main body 10. The door coupling groove 14 is provided at a position corresponding to that of the closed door 30 on the front surface of the main body 10.

The coupling hole 15 is provided at a position corresponding to that of the door 30 on the front surface of the main body 10. The coupling hole 15 is installed at a position corresponding to that of an engaging member 31 of the door 30 in the door coupling groove 14. Therefore, the door locking device 100 coupled to the coupling hole 15 is provided at a position corresponding to that of the engaging member 31.

A reinforcement bracket 17 is installed behind the coupling hole 15. The reinforcement bracket 17 is coupled to a rear surface of the main body 10 in which the coupling hole 15 is installed. The reinforcement bracket 17 is coupled to the rear surface of the main body 10, and thus the strength of the vicinity of the coupling hole 15 in which the door locking device 100 is installed can be improved. In the reinforcement bracket 17, a bracket hole 17*a* is provided at a position facing the coupling hole 15.

Figure 4:
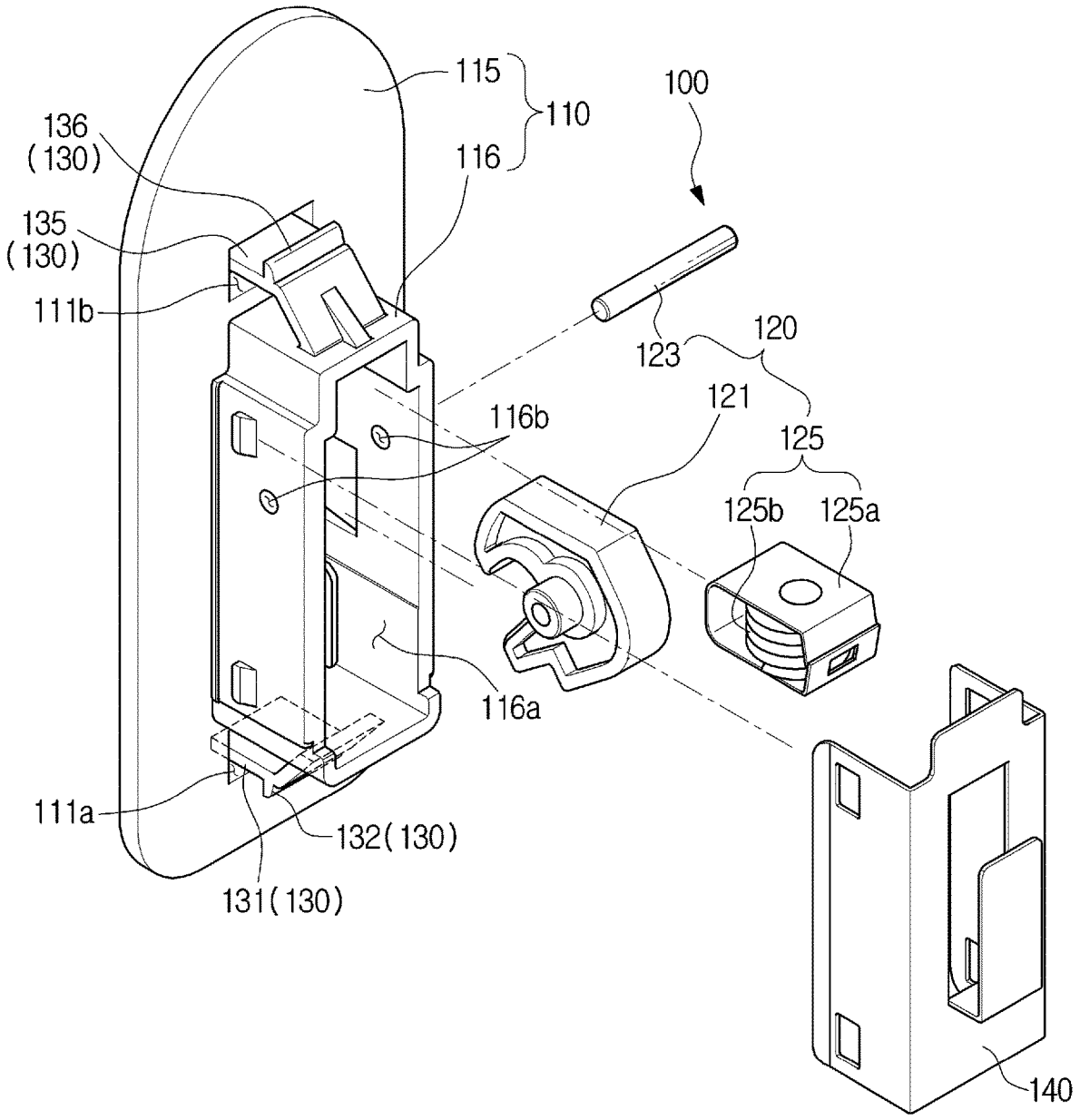
FIG. 4 illustrates a configuration of the door locking device of FIG. 3 according to various embodiments of the present disclosure.
Figure 5:
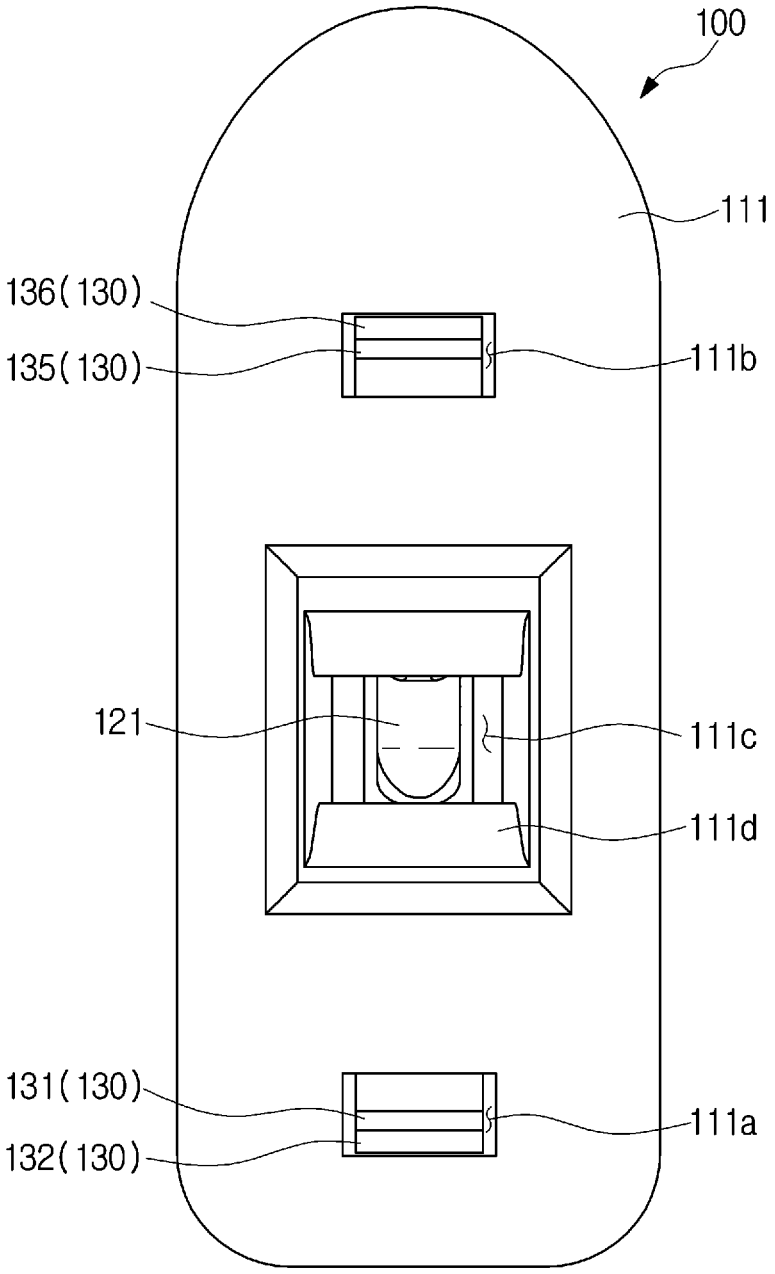
FIG. 5 illustrates a front surface of the door locking device of FIG. 3 according to various embodiments of the present disclosure.
Figure 6:
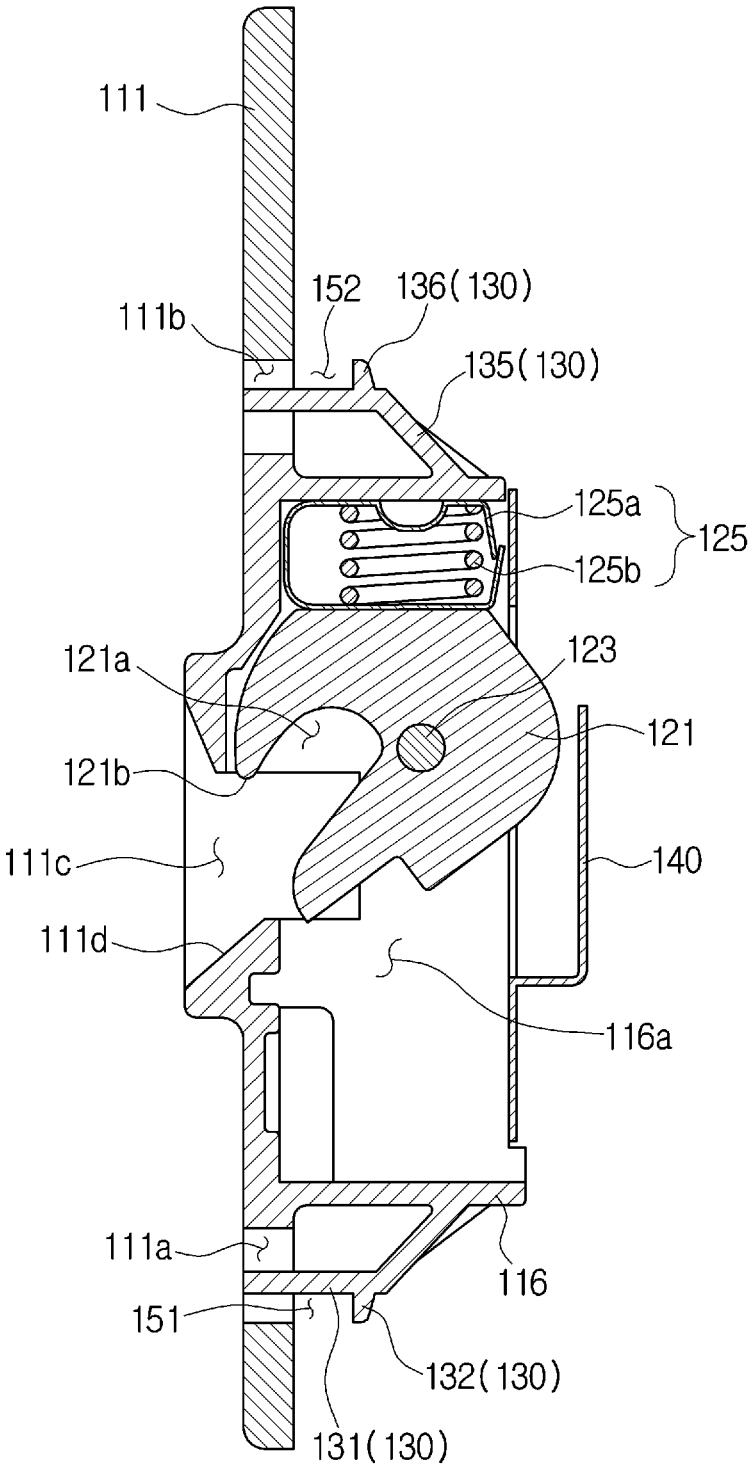
FIG. 6 illustrates a side surface of the door locking device of FIG. 3 according to various embodiments of the present disclosure.
Figure 7:
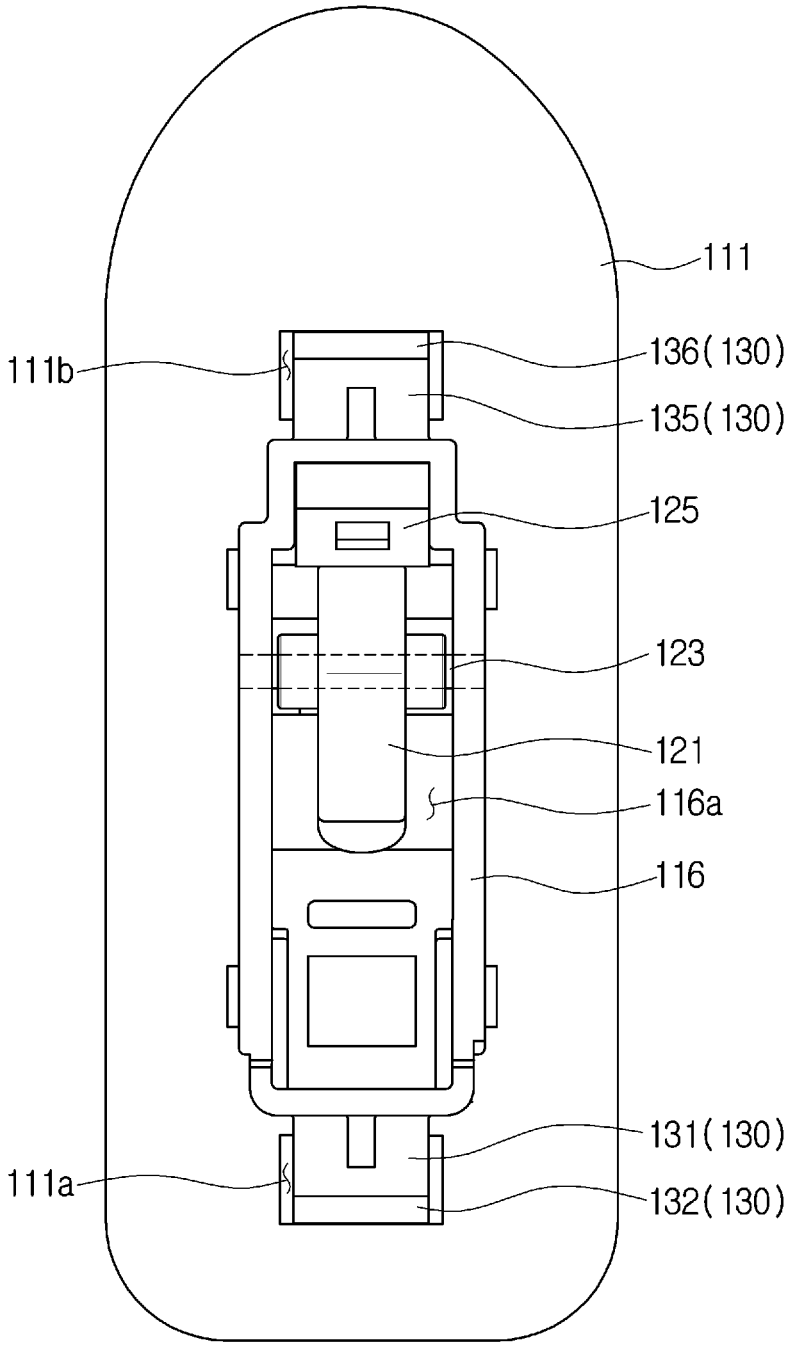
FIG. 7 illustrates a rear surface of the door locking device of FIG. 3 according to various embodiments of the present disclosure.

FIG. 4 is an exploded perspective view illustrating a configuration of the door locking device of FIG. 3. FIG. 5 is a view illustrating a front surface of the door locking device of FIG. 3. FIG. 6 is a cross-sectional view illustrating a side surface of the door locking device of FIG. 3. FIG. 7 is a view illustrating a rear surface of the door locking device of FIG. 3.

Referring to FIGS. 3 to 7, the door locking device 100 includes a body unit 110. The body unit 110 forms an exterior of the door locking device 100. The body unit 110 includes a front plate 111 and a rear case 116.

The front plate 111 is disposed at a front end of the door locking device 100. The front plate 111 includes a wider cross-section than the coupling hole 15 of the main body 10. When the rear case 116 is inserted into the coupling hole 15, the front plate 111 is provided so that the door locking device 100 does not move behind the coupling hole 15.

An insertion hole 111*c* is formed in the front plate 111. The insertion hole 111*c* is provided so that the engaging member 31 of the door 30 can be inserted. The insertion hole 111*c* is formed at a position corresponding to that of the engaging member 31 when the door locking device 100 is coupled to the coupling hole 15. The insertion hole 111*c* is provided so that an internal space 116*a* of the rear case 116 communicates with the outside. The insertion hole 111*c* is provided at a position facing a locking unit 120 to be described below. Therefore, the insertion hole 111*c* is provided at a position facing the engaging member 31 and the locking unit 120.

As illustrated in FIGS. 5 and 6, guide units 111*d* is provided inside the insertion hole 111*c*. The guide units 111*d* is provided in a shape inclined from a front surface of the front plate 111 to a rear thereof toward a center of the insertion hole 111*c*. The guide units 111*d* are formed at edges of the insertion hole 111*c* provided in a rectangular shape.

A first hole 111*a* and a second hole 111*b* are formed in the front plate 111. The first hole 111*a* provides a space in which an end of a first lever 131 to be described below moves vertically. The first hole 111*a* is provided at a position facing the first lever 131. The first hole 111*a* is formed under the insertion hole 111*c*.

The second hole 111*b* is formed above the insertion hole 111*c*. The second hole 111*b* provides a space in which an end of a second lever 135 to be described below moves vertically. The second hole 111*b* is provided at a position facing the second lever 135.

The rear case 116 is installed behind the front plate 111. The rear case 116 is coupled to a rear surface of the front plate 111. The rear case 116 is provided to be inserted into the coupling hole 15 of the main body 10. To this end, the rear case 116 is provided to have a cross-section in a shape corresponding to that of the coupling hole 15.

The rear case 116 is coupled to the front plate 111 to fonts the internal space 116*a*. The internal space 116*a* provides a space in which the locking unit 120 to be described below is disposed. A front surface of the rear case 116 is coupled to the front plate 111 and a rear surface thereof is coupled to a rear cover 140. Thus, the rear case 116 form the internal space 116*a*.

A pair of rotating shaft coupling holes 116*b* are formed in both side surfaces of the rear case 116. The pair of rotating shaft coupling holes 116*b* are formed at positions facing each other in both side surfaces of the rear case 116. The rotating shaft coupling holes 116*b* are provided so that a rotating shaft 123 of the locking unit 120 to be described below is coupled thereto.

The door locking device 100 further includes the locking unit 120. The locking unit 120 is disposed in the internal space 116*a* of the rear case 116. The locking unit 120 fixes the engaging member 31 to maintain a locked state when the door 30 is closed.

The locking unit 120 includes a locking member 121. As illustrated in FIG. 6, an engaging groove 121*a* is formed in a side of the locking member 121. The engaging groove 121*a* is provided so that the engaging member 31 passing through the insertion hole 111*c* can be coupled thereto. When the engaging member 31 is coupled to the engaging groove 121*a*, an engaging unit 121*b* is inserted into an engaging hole 31*a* provided in the engaging member 31. The door 30 is fixed to the door locking device 100 while the engaging member 31 is fixed to the locking member 121.

The locking member 121 is installed in the internal space 116*a* of the rear case 116 to be rotatable. The locking member 121 is coupled to the rotating shaft 123 and thus is installed in the internal space 116*a* to be rotatable. The rotating shaft 123 is coupled to the pair of rotating shaft coupling holes 116*b* formed in the rear case 116. Thus, the locking member 121 is installed in the internal space 116*a* of the rear case 116 to be rotatable.

According to certain embodiments, the locking member 121 is configured to move horizontally in the internal space 116*a* of the rear case 116. As illustrated in FIG. 7, when the locking member 121 is coupled to the rotating shaft 123 in the internal space 116*a*, the locking member 121 is provided so that a predetermined distance is formed in a longitudinal direction of the rotating shaft 123. Thus, when external force is applied, the locking member 121 is provided to move left or right along the rotating shaft 123 within a range of the internal space 116*a*.

The locking unit 120 further includes a spring member 125. The spring member 125 is disposed above the locking member 121. The spring member 125 is disposed between the locking member 121 and an upper surface of the internal space 116*a* of the rear case 116. When the locking member 121 is rotated by the external force and then the external force is removed, the spring member 125 restores the locking member 121 to its original position. Therefore, when the locking member 121 is rotated by the engaging member 31 and then the engaging member 31 is separated from the door locking device 100, the spring member 125 restore the locking member 121 to its original position.

The spring member 125 includes a leaf spring 125*a* and a coil spring 125*b*. The coil spring 125*b* is disposed in an internal space of the leaf spring 125*a*. Accordingly, the restoring force of the spring member 125 can be improved.

The door locking device 100 further include a restoring member 130. The restoring member 130 is provided so that the door locking device 100 coupled to the main body 10 can move vertically. The restoring member 130 is provided to have restoring force.

The restoring member 130 includes a first lever 131. The first lever 131 is provided to be in contact with a lower end of the coupling hole 15 when the door locking device 100 is coupled to the main body 10. The first lever 131 is provided to extend from a bottom surface of the rear case 116 to the front plate 111. The first lever 131 is provided to be spaced a predetermined distance below the bottom surface of the rear case 116. The first lever 131 is provided so that an end thereof is located inside the first hole 111*a* of the front plate 111. The first lever 131 may have restoring force.

The restoring member 130 further includes a first engaging unit 132. The first engaging unit 132 is provided in a shape that protrudes downward from a bottom surface of the first lever 131. The first engaging unit 132 is formed at a position spaced a predetermined distance behind the front plate 111 on the bottom surface of the first lever 131. The first engaging unit 132 forms a first insertion space 151 to be described below along with the front plate 111 and the first lever 131. A side of the main body 10 is inserted into the first insertion space 151, and thus the main body 10 and the door locking device 100 is fixed.

The restoring member 130 further includes a second lever 135.

The second lever 135 is provided to be in contact with an upper end of the coupling hole 15 when the door locking device 100 is coupled to the main body 10. The second lever 135 is provided to extend from an upper surface of the rear case 116 to the front plate 111. The second lever 135 is provided to be spaced a predetermined distance above the upper surface of the rear case 116. The second lever 135 is provided so that an end thereof is located inside the second hole 111*b* of the front plate 111. The second lever 135 may have restoring force.

The restoring member 130 further includes a second engaging unit 136. The second engaging unit 136 is provided in a shape that protrudes upward from an upper surface of the second lever 135. The second engaging unit 136 is formed at a position spaced a predetermined distance behind the front plate 111 on the upper surface of the second lever 135. The second engaging unit 136 forms a second insertion space 152 to be described below along with the front plate 111 and the second lever 135. A side of the main body 10 is inserted into the second insertion space 152, and thus the main body 10 and the door locking device 100 is fixed.

The door locking device 100 further includes the first insertion space 151 and the second insertion space 152. The first insertion space 151 is formed as a space surrounded by the front plate 111, the first lever 131, and the first engaging unit 132. The first insertion space 151 is provided so that a side of the main body 10 is coupled and fixed to the door locking device 100. The first insertion space 151 is provided as a space into which the lower end of the coupling hole 15 is inserted.

The second insertion space 152 is formed as a space surrounded by the front plate 111, the second lever 135, and the second engaging unit 136. The second insertion space 152 is provided for coupling and fixing a side of the main body 10 to the door locking device 100. The second insertion space 152 is provided as a space into which the upper end of the coupling hole 15 is inserted.

The door locking device 100 further includes a first fixing unit.

The first fixing unit serves to fix a lower portion of the door locking device 100 to the main body 10. The first fixing unit includes the first insertion space 151. To this end, the first fixing unit includes the above-described first lever 131 and first engaging unit 132.

The door locking device 100 further includes a second fixing unit.

The second fixing unit serves to fix an upper portion of the door locking device 100 to the main body 10. The second fixing unit includes the second insertion space 152. To this end, the second fixing unit includes the above-described second lever 135 and second engaging unit 136.

Figure 8:
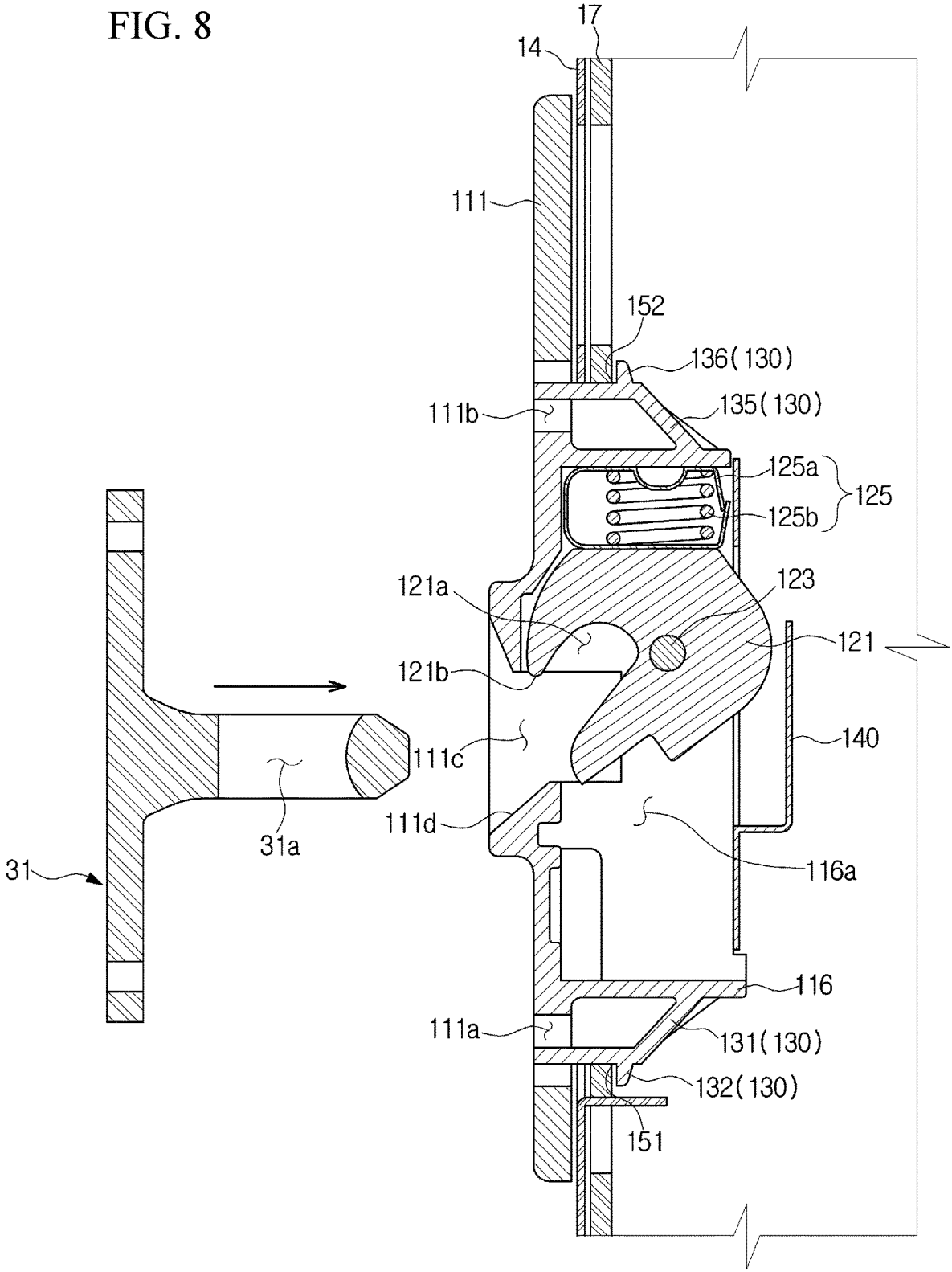
FIGS. 8, 9 and 10 illustrate a process in which a door of FIG. 1 is coupled to a door locking device according to various embodiments of the present disclosure.
Figure 9:
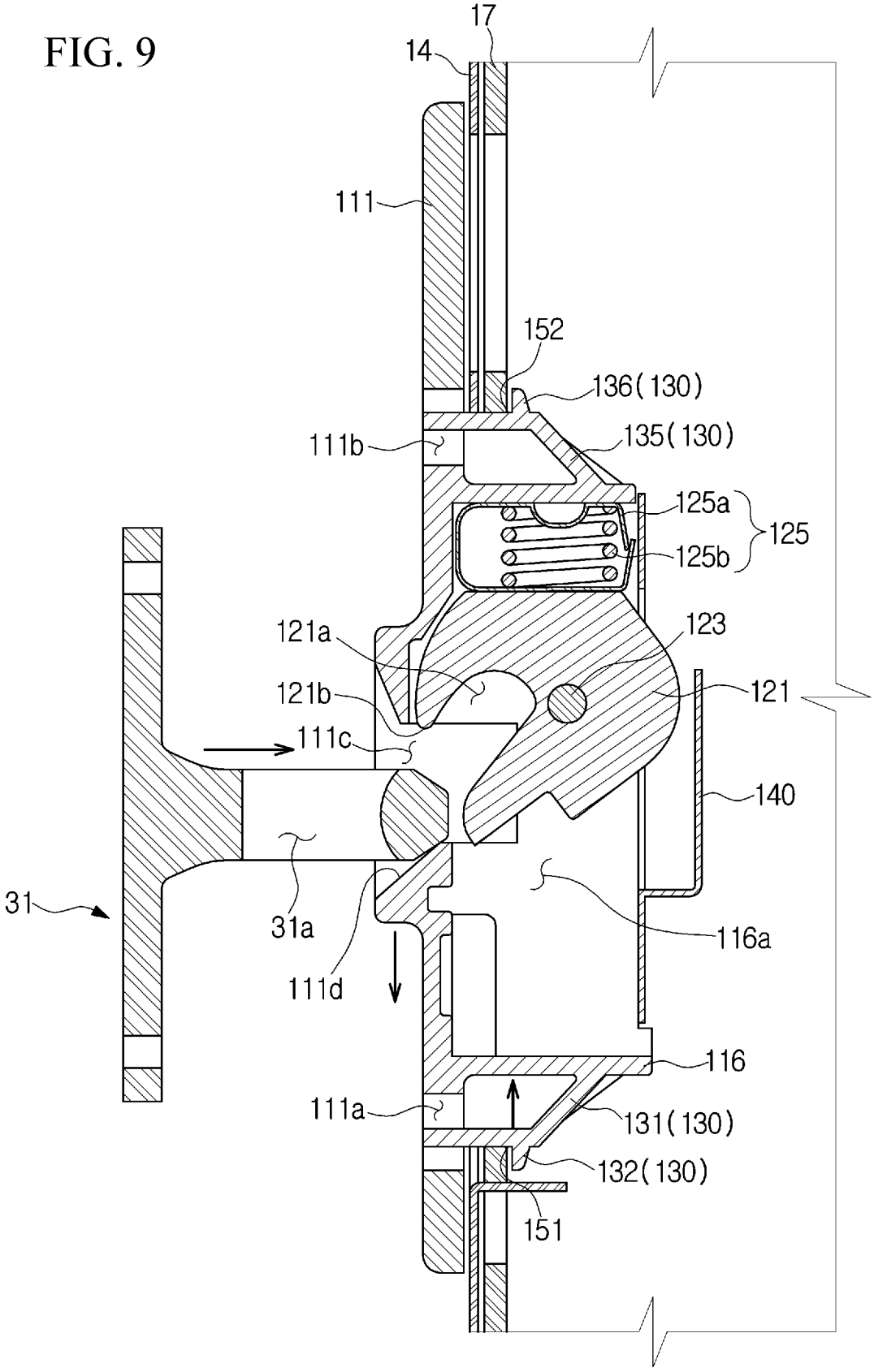
Figure 10:
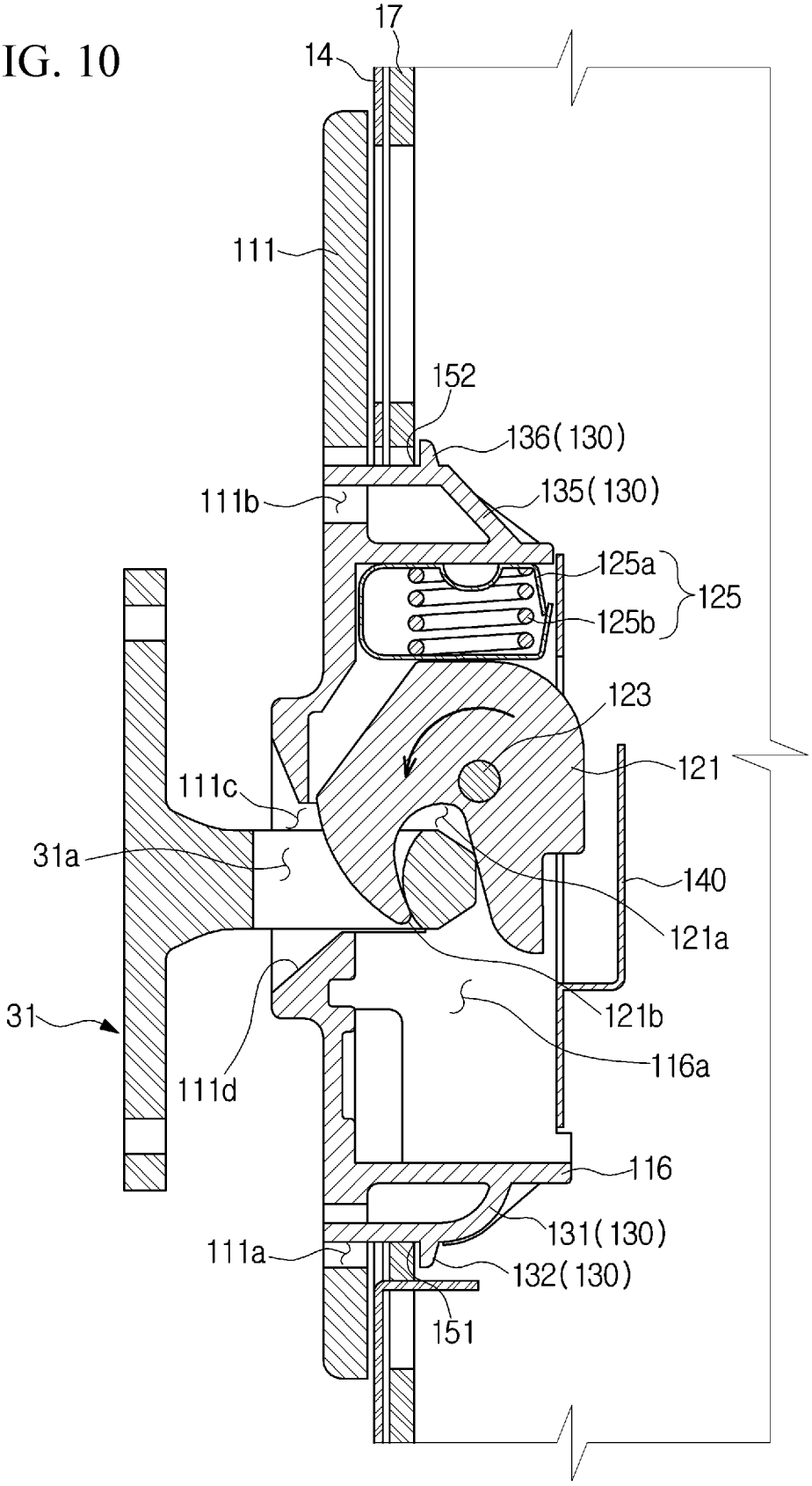

FIGS. 8 to 10 are views illustrating a process in which the door of FIG. 1 is coupled to the door locking device.

Referring to FIGS. 8 to 10, a process in which the engaging member 31 of the door 30 is coupled to the door locking device 100 according to an embodiment of the present disclosure is illustrated. In a clothing dryer or a washing machine which is configured with the door 30 coupled to the front surface of the main body 10 using a hinge, a sagging phenomenon of the door 30 occurs with the passage of time. As illustrated in FIG. 8, due to the sagging phenomenon of the door 30, the engaging member 31 is located below the insertion hole 111*c* of the door locking device 100.

When a user moves the open door 30 to the main body 10, the engaging member 31 is moved toward the door locking device 100 along with the door 30. As illustrated in FIG. 9, the engaging member 31 may collide with the guide unit 111*d* formed under the insertion hole 111*c* of the door locking device 100 due to the sagging phenomenon of the door 30.

In general, when a position of the door 30 is changed due to the sagging phenomenon of the door 30 or the like, it is difficult to accurately couple the engaging member 31 to the insertion hole 111*c* of the door locking device 100. Thus, the door 30 and the door locking device 100 may be damaged when the engaging member 31 collides with the door locking device 100.

However, the door locking device 100 according to an embodiment of the present disclosure is provided so that a position of the door locking device 100 can move vertically due to the restoring member 130. Thus, when the engaging member 31 collides with the guide unit 111*d* formed under the insertion hole 111*c* as illustrated in FIG. 9, the door locking device 100 is moved downward while coupled to the coupling hole 15. The door locking device 100 is moved toward the bottom surface of the rear case 116 while the first lever 131 is moved upward due to the collision of the engaging member 31 and the door locking device 100. The first lever 131 is moved upward from the first hole 111*a* due to the collision of the engaging member 31 and the door locking device 100, and thus the door locking device 100 is moved downward while coupled to the coupling hole 15.

When the insertion hole 111*c* is moved to the same height as the engaging member 31 while the door locking device 100 is moved downward, the engaging member 31 is inserted into the insertion hole 111*c*. As illustrated in FIG. 10, the engaging member 31 is coupled to the locking member 121 inside the insertion hole 111*c*. The engaging member 31 rotates the locking member 121 while being moved to the inside of the insertion hole 111*c* with a front surface thereof in contact with a side of the locking member 121. The engaging member 31 rotates the locking member 121 while being moved to the inside of the insertion hole 111*c* while in contact with a side of the engaging groove 121*a*. The locking member 121, which is rotated in this way, is inserted into the engaging hole 31*a* of the engaging member 31 while the engaging unit 121*b* is rotated. The door 30 is coupled to the door locking device 100 and remains in a locked state while the engaging unit 121*b* is inserted into the engaging hole 31*a*.

When the door 30 is opened, the engaging member 31 and the door locking device 100 are driven in order through FIG. 10, FIG. 9, and FIG. 8. The engaging member 31 is moved away from the door locking device 100 while coupled to the engaging groove 121*a*. The engaging unit 121*b* is separated from the engaging hole 31*a* while the locking member 121 is rotated along with the engaging member 31. When the engaging member 31 is separated from the locking member 121, the locking member 121 is restored to the state illustrated in FIG. 8 due to the restoring force of the spring member 125.

When the engaging member 31 is separated from the door locking device 100, the door locking device 100 is also restored to its original position as illustrated in FIG. 8. When the engaging member 31 is separated from the door locking device 100, the restoring member 130 restores the door locking device 100 to its original position. The first lever 131 and the second lever 135 restore the door locking device 100 to its original position due to the restoring force.

As described above, the door locking device 100 is configured to move vertically, and is provided so that the door 30 and the door locking device 100 are stably coupled to each other despite the sagging phenomenon of the door 30. Thus, malfunction or damage of the door 30 and the door locking device 100 can be reduced, and the durability of the clothing dryer 1 can be improved Further, the door locking device 100 according to an embodiment of the present disclosure is configured so that the locking member 121 can move horizontally along the rotating shaft 123 as illustrated in FIG. 7. Thus, even when the engaging member 31 is moved to the left side or right side due to the sagging phenomenon of the door 30 or the like, the locking member 121 is coupled to the engaging member 31 while being moved along the rotating shaft 123.

In this manner, the door locking device 100 is configured to move vertically and horizontally and is provided so that the engaging member 31 is stably coupled even when the position of the door 30 is changed. Thus, malfunction or damage of the door 30 and the door locking device 100 can be reduced, and the durability of the clothing dryer 1 can be improved.

Figure 11:
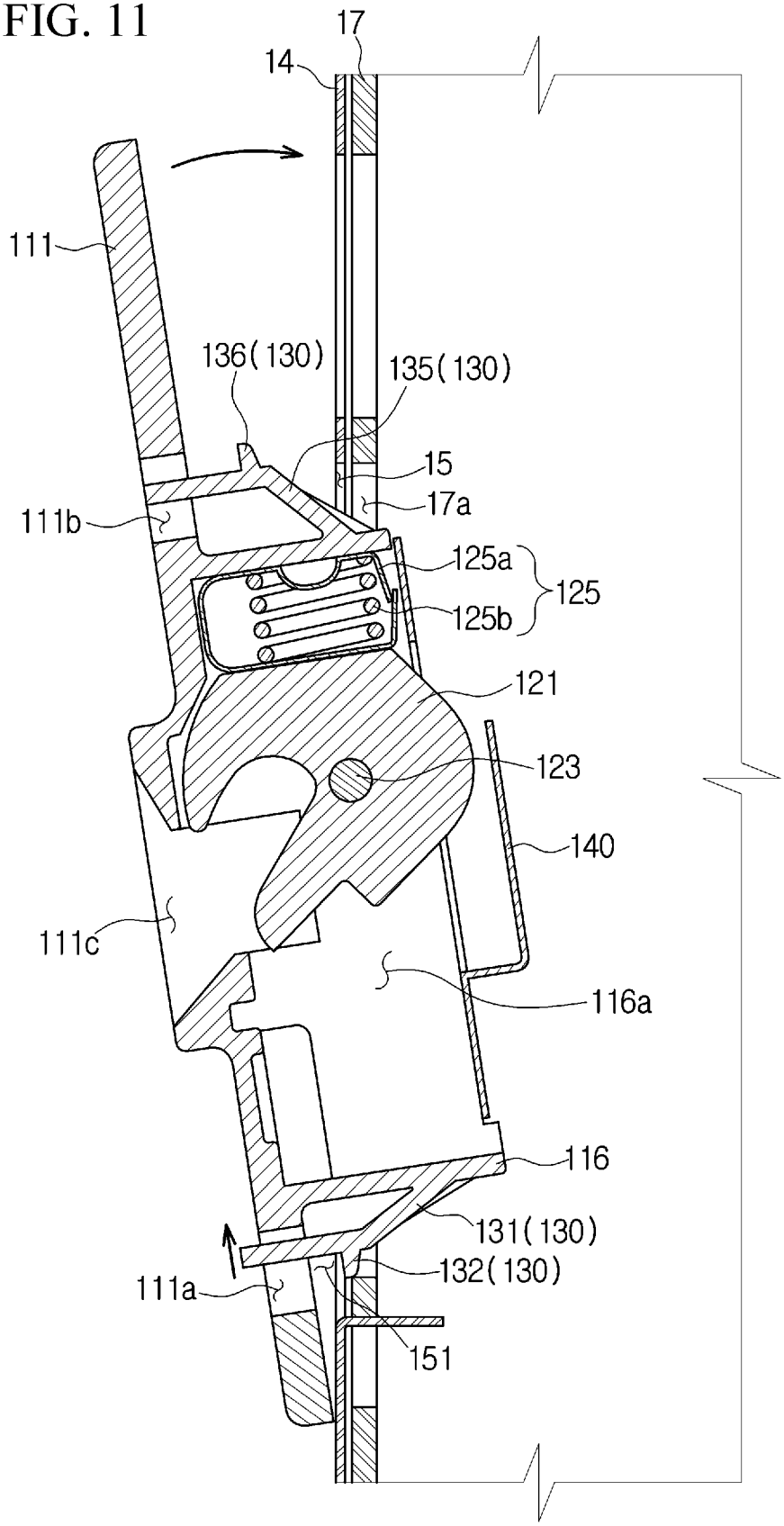
FIGS. 11 and 12 illustrate a process in which a door locking device of FIG. 1 is coupled to a main body according to various embodiments of the present disclosure.
Figure 12:
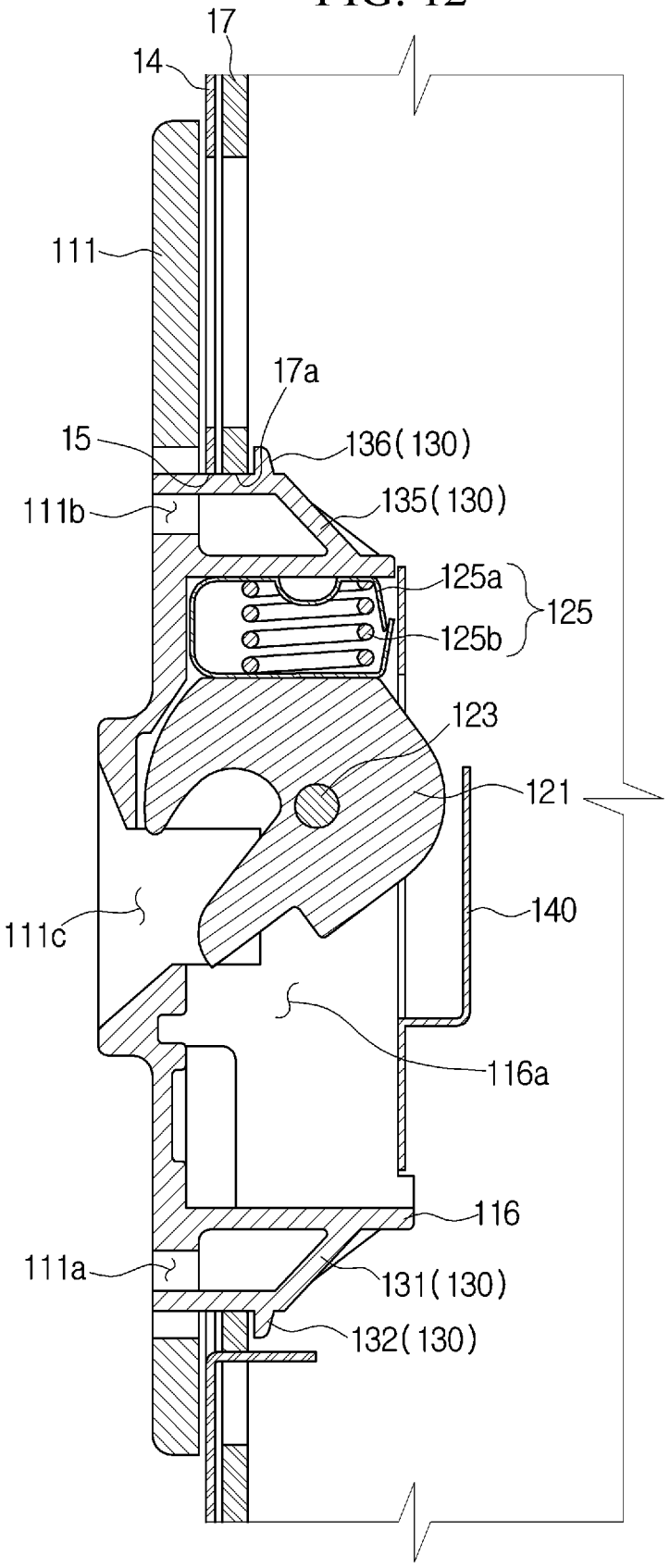

FIGS. 11 and 12 are views illustrating a process in which the door locking device of FIG. 1 is coupled to the main body.

Referring to FIGS. 11 and 12, the door locking device 100 is provided to be coupled to the coupling hole 15 formed on the front surface of the main body 10 without any coupling member such as a screw. The door locking device 100 is coupled to the coupling hole 15 while a portion of the main body 10 is inserted into the first insertion space 151 and the second insertion space 152 provided in the rear case 116.

As illustrated in FIG. 11, in order for the door locking device 100 to be coupled to the main body 10, the main body 10 located on a lower portion of the coupling hole 15 may first be inserted into the first insertion space 151. The main body 10 is easily inserted into the first insertion space 151 while the first lever 131 is moved upward from the first hole 111*a* due to the restoring force. On the other hand, the main body 10 may first be inserted into the second insertion space 152 rather than the first insertion space 151.

When the main body 10 is inserted into the first insertion space 151, an upper portion of the door locking device 100, which is not coupled, is moved in a direction of the coupling hole 15. Thus, the main body 10 located on an upper portion of the coupling hole 15 is inserted into the second insertion space 152. In a process in which the main body 10 located on the upper portion of the coupling hole 15 is inserted into the second insertion space 152, the door locking device 100 is more easily coupled to the coupling hole 15 while the second lever 135 is moved downward from the second hole 111*b*.

The door locking device 100 inserted into the coupling hole 15 provides support by which the main body 10 is not separated from the first insertion space 151 and the second insertion space 152 due to the first engaging unit 132 and the second engaging unit 136. Thus, the door locking device 100 is stably coupled to the coupling hole 15.

As described above, the door locking device 100 according to certain embodiments of the present disclosure is easily coupled to the main body 10 without any coupling member such as a screw or the like. Thus, an assembly process of the clothing dryer 1 can be performed more efficiently and the productivity can be improved.

Hereinafter, a door locking device 200 according to another embodiment of the present disclosure will be described.

Figure 13:
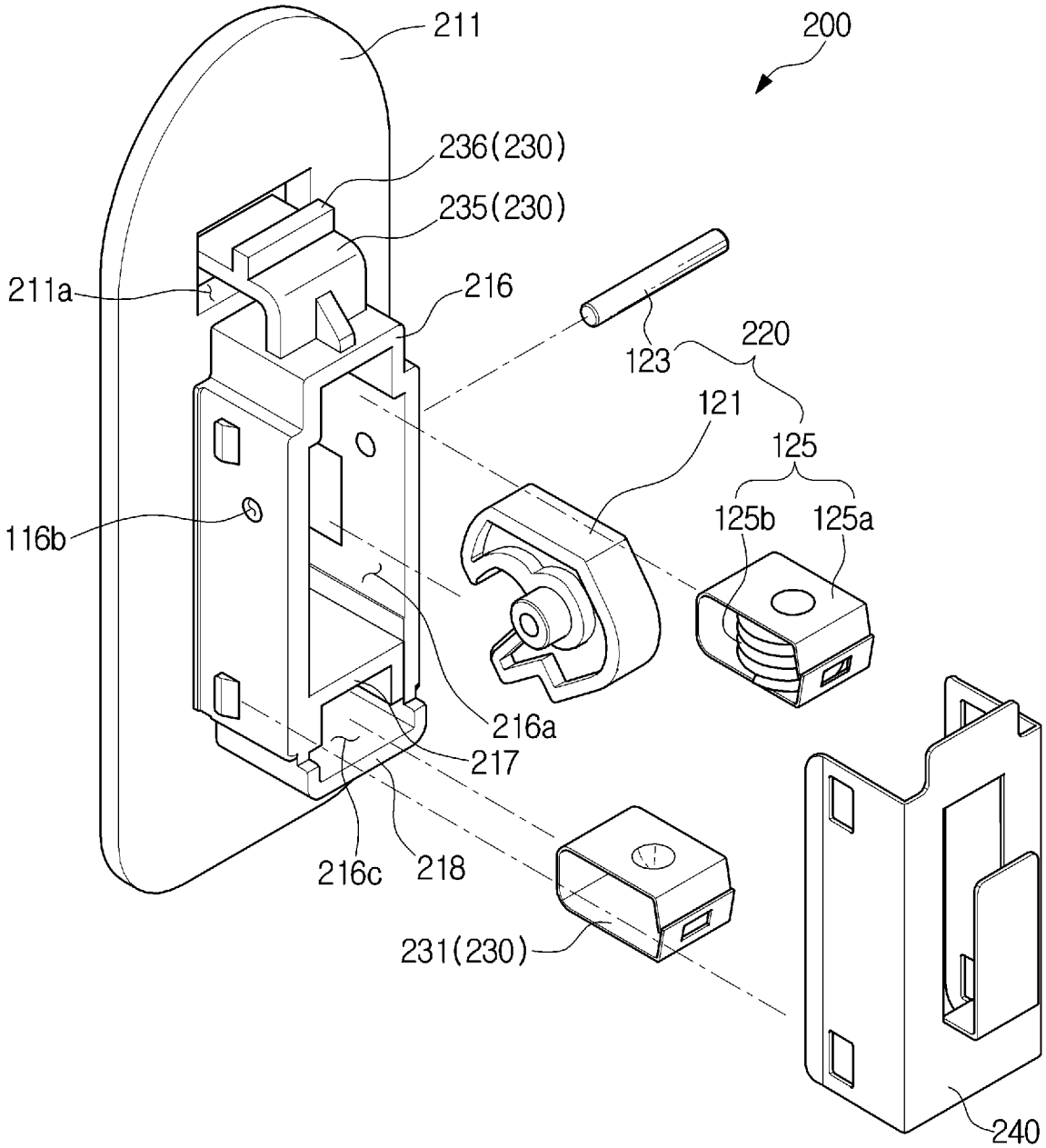
FIG. 13 illustrates a configuration of a door locking device according to various embodiments of the present disclosure.
Figure 14:
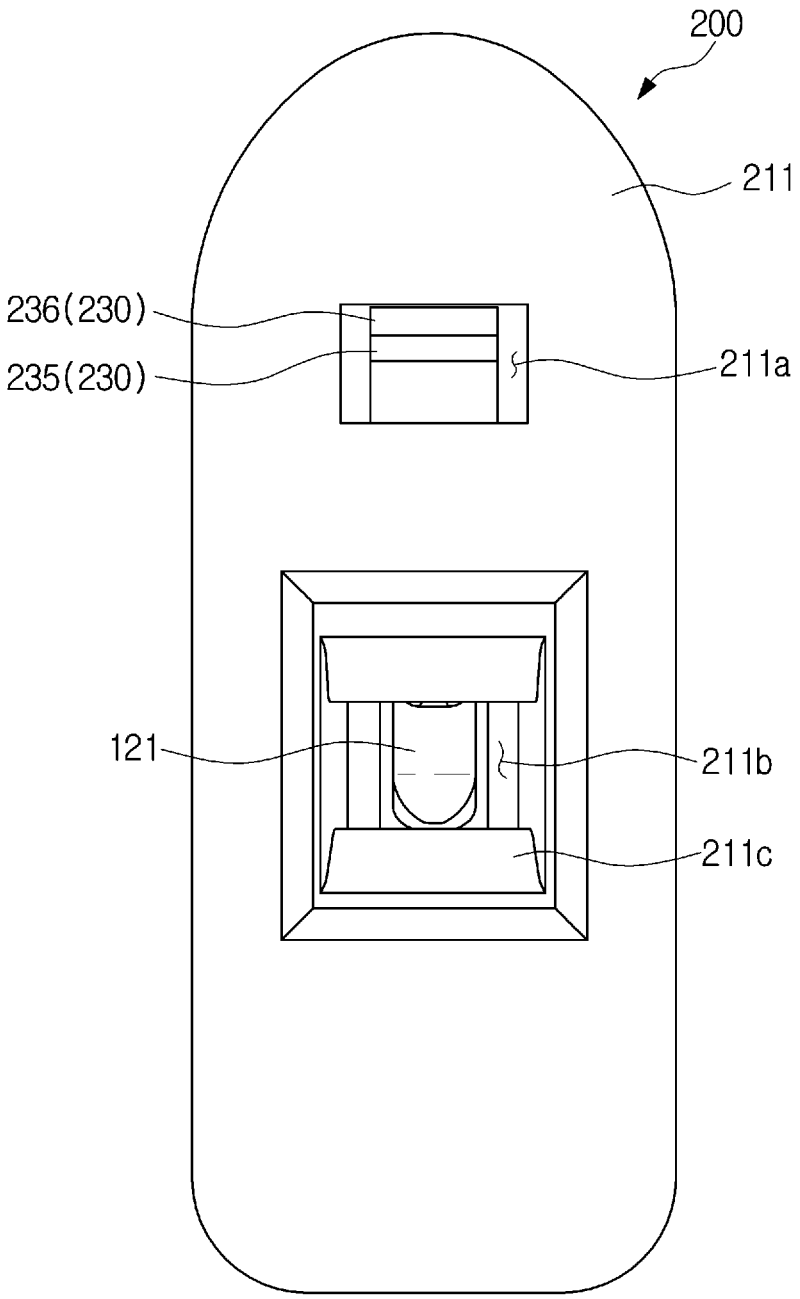
FIG. 14 illustrates a front surface of the door locking device of FIG. 13 according to various embodiments of the present disclosure.
Figure 15:
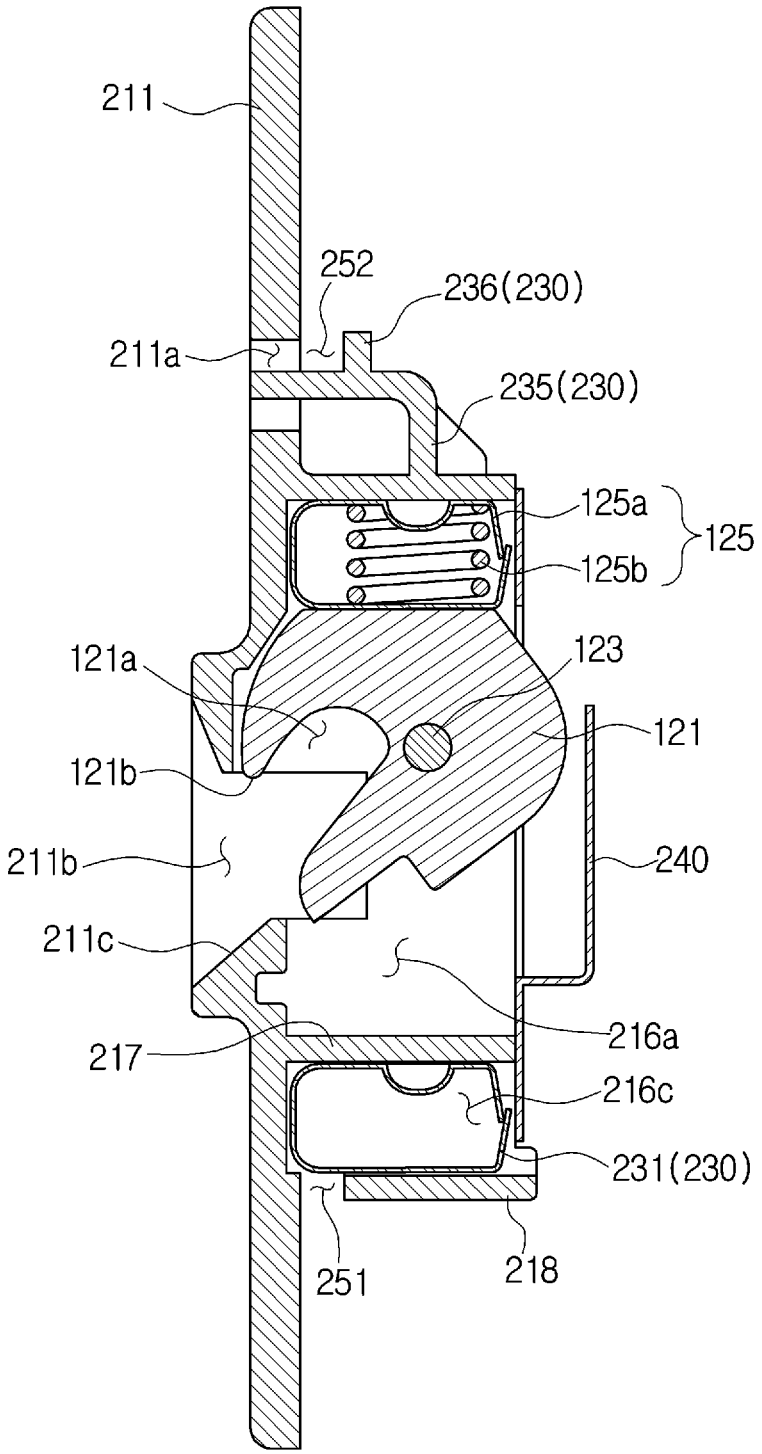
FIG. 15 illustrates a side surface of the door locking device of FIG. 13 according to various embodiments of the present disclosure.
Figure 16:
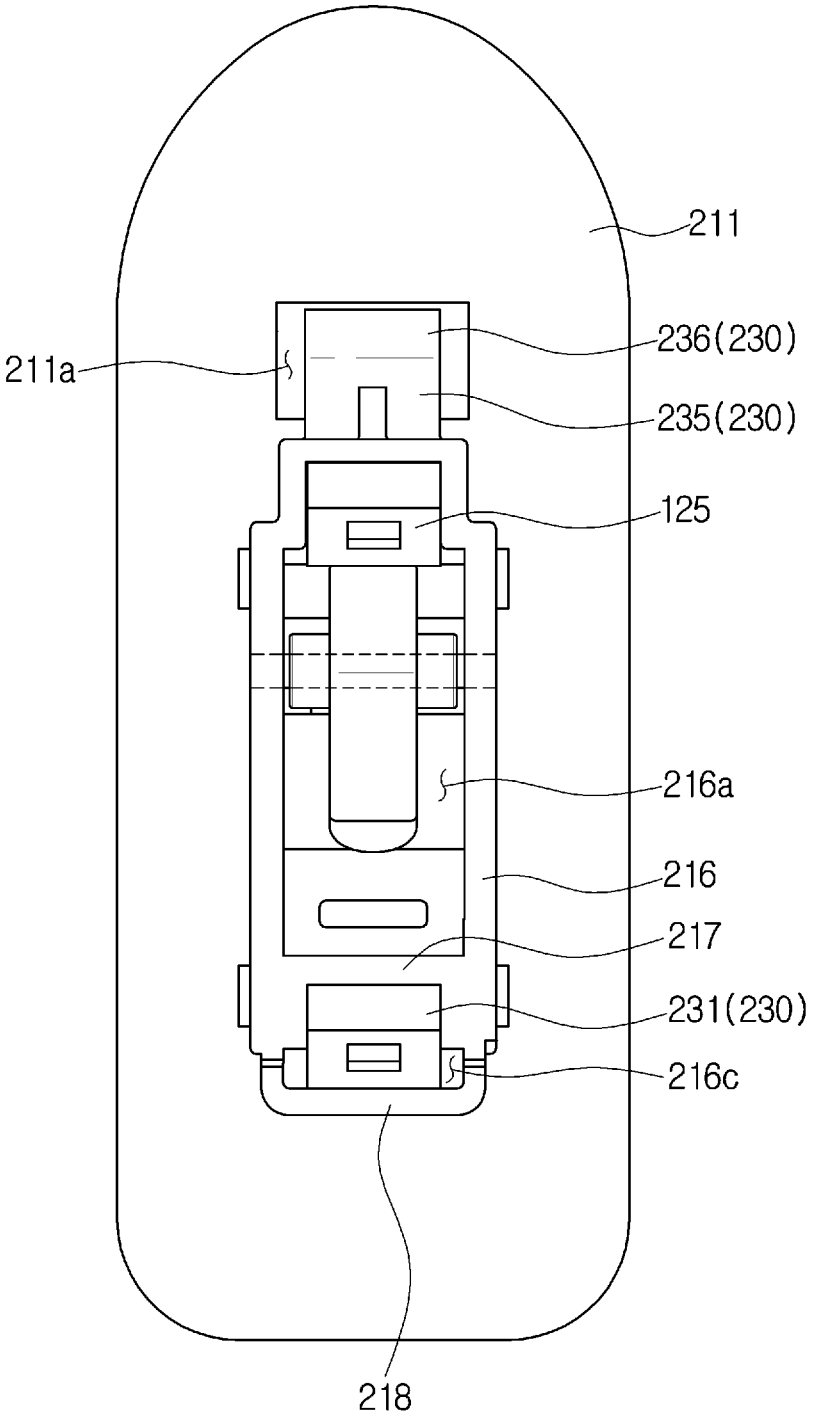
FIG. 16 illustrates a rear surface of the door locking device of FIG. 13 according to various embodiments of the present disclosure.

FIG. 13 is an exploded perspective view illustrating a configuration of the door locking device according to another embodiment of the present disclosure. FIG. 14 is a view illustrating a front surface of the door locking device of FIG. 13. FIG. 15 is a cross-sectional view illustrating a side surface of the door locking device of FIG. 13. FIG. 16 is a view illustrating a rear surface of the door locking device of FIG. 13.

Referring to FIGS. 13 to 16, the door locking device 200 includes a body unit 210, a locking unit 220, a restoring member 230, and a rear cover 240. In comparison with the door locking device 100 of FIG. 4, the door locking device 200 is provided to include some components different from those of the door locking device 100 of FIG. 4 such as the body unit 210 and restoring member 230. Hereinafter, the door locking device 200 will be described focusing on differences from the door locking device 100 of FIG. 4 and description of the same components is omitted.

The body unit 210 forms an exterior of the door locking device 200. The body unit 210 includes a front plate 211 and a rear case 216.

The front plate 211 is disposed at a front end of the door locking device 200. The front plate 211 includes a wider cross-section than the coupling hole 15 of the main body 10. Thus, the front plate 211 is provided so that the door locking device 200 does not move behind the coupling hole 15 when the rear case 216 is inserted into the coupling hole 15.

An insertion hole 211*b* is formed in the front plate 211. The insertion hole 211*b* is provided so that the engaging member 31 of the door 30 can be inserted thereinto. The insertion hole 211*b* is formed at a position corresponding to that of the engaging member 31 in a state in which the door locking device 200 is coupled to the coupling hole 15. The insertion hole 211*b* is provided so that an internal space 216*a* of the rear case 216 communicates with the outside. The insertion hole 211*b* is provided at a position facing the locking unit 220. Therefore, the insertion hole 211*b* is provided at a position facing the engaging member 31 and the locking unit 220.

As illustrated in FIGS. 14 and 15, guide units 211*c* are provided inside the insertion hole 211*b*. The guide units 211*c* are provided in a shape inclined from a front surface of the front plate 211 to a rear thereof to a rear thereof toward a center of the insertion hole 211*b*. The guide units 211*c* are formed at edges of the insertion hole 211*b* provided in a rectangular shape.

A third hole 211*a* is formed in the front plate 211. The third hole 211*a* provides a space in which an end of a third lever 235 to be described below is moved. The third hole 211*a* is provided at a position facing the third lever 235. The third hole 211*a* is formed above the insertion hole 211*b*.

The rear case 216 is installed behind the front plate 211. The rear case 216 is coupled to a rear surface of the front plate 211. The rear case 216 is provided to be inserted into the coupling hole 15 of the main body 10. To this end, the rear case 216 is provided to include a cross-section in a shape corresponding to that of the coupling hole 15.

The rear case 216 is coupled to the front plate 211 to form the internal space 216*a*. The internal space 216*a* provides a space in which the locking unit 220 is disposed. A front surface of the rear case 216 is coupled to the front plate 211, and a rear surface thereof is coupled to the rear cover 240. Thus, the rear case 216 forms the internal space 216*a*.

In the rear case 216, a restoring spring insertion space 216*c* is formed under the internal space 216*a*. The restoring spring insertion space 216*c* is formed as a space into which a restoring spring 231 to be described below is inserted to be fixed to an inside of the rear case 216. The restoring spring insertion space 216*c* is separated from the internal space 216*a* by a partition wall 217.

The restoring spring insertion space 216*c* is provided so that a portion in a front of the restoring spring 231 is in contact with the main body 10 in a state in which the door locking device 200 is coupled to the main body 10. To this end, the restoring spring insertion space 216*c* is formed so that a front end of a bottom surface 218 of the rear case 216 is spaced apart from the rear of the front plate 211. A first insertion space 251 is formed between the front end of the bottom surface 218 of the rear case 216 and the front plate 211.

The restoring member 230 is provided so that the door locking device 200 coupled to the main body 10 can move vertically. The restoring member 230 is provided to include a restoring force.

The restoring member 230 includes the restoring spring 231. The restoring spring 231 is disposed in the restoring spring insertion space 216*c*. The restoring spring 231 is provided to be in contact with a side of the main body 10 through the first insertion space 251 in the state in which the door locking device 200 is coupled to the main body 10. The restoring spring 231 is provided as a leaf spring.

The restoring member 230 further includes a third lever 235. A third engaging unit 236 is formed above the third lever 235. The third lever 235 and the third engaging unit 236 is provided in the same configuration as the second lever 135 and the second engaging unit 136 of the door locking device 100.

The third lever 235 and the third engaging unit 236 form a second insertion space 252 along with the front plate 211. The second insertion space 252 is provided as a space into which the main body 10 disposed above the coupling hole 15 is inserted.

The door locking device 200 further includes a first fixing unit.

The first fixing unit serves to fix a lower portion of the door locking device 200 to the main body 10. The first fixing unit includes the first insertion space 251. To this end, in the first fixing unit, a predetermined space is formed between the bottom surface 218 of the restoring spring insertion space 216*c* and the front plate 211.

The door locking device 100 further includes a second fixing unit.

The second fixing unit serves to fix an upper portion of the door locking device 200 to the main body 10. The second fixing unit includes the second insertion space 252. To this end, the second fixing unit includes the above-described third lever 235 and third engaging unit 236.

Figure 17:
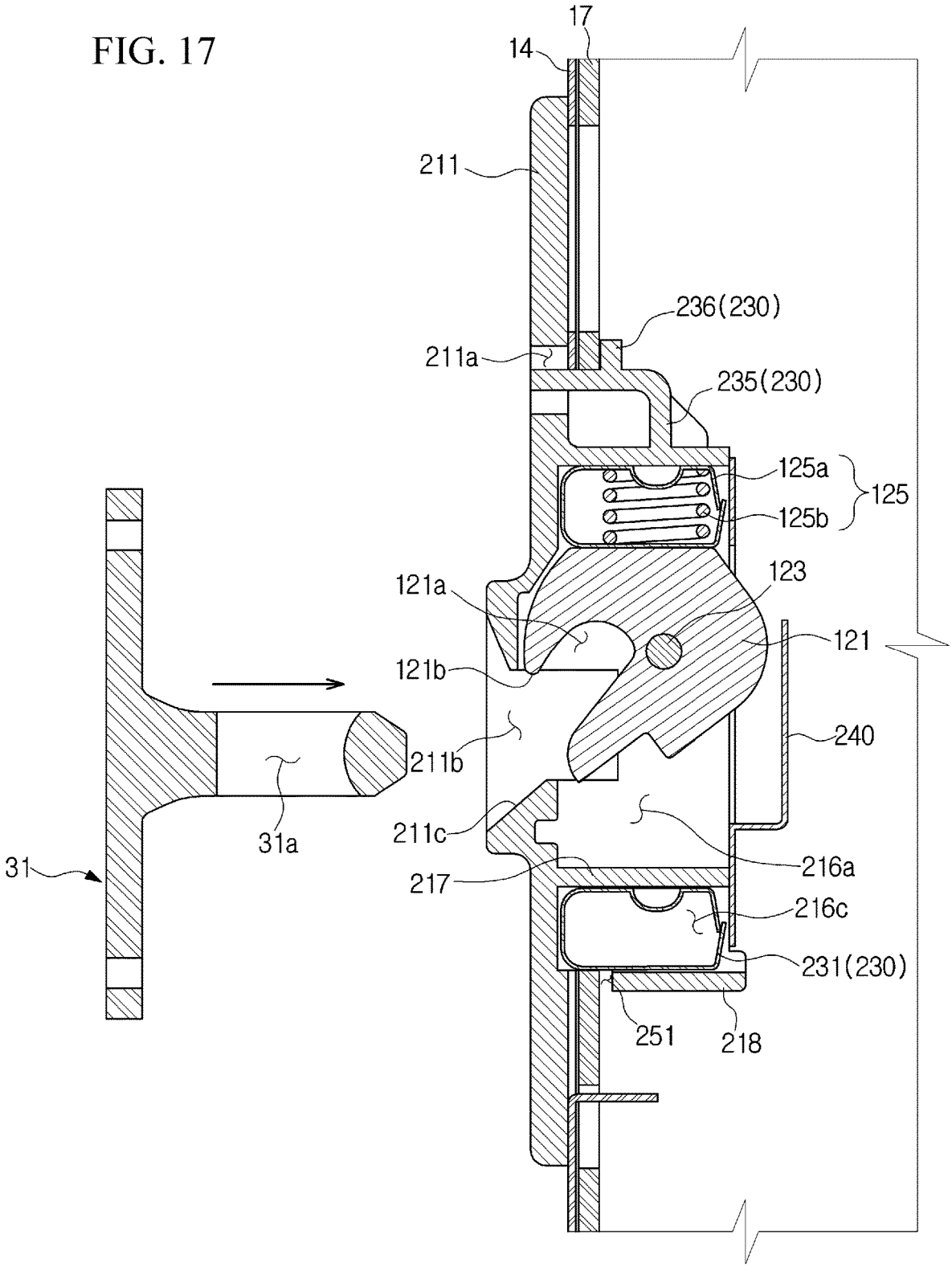
FIGS. 17, 18 and 19 illustrate a process in which a door is coupled to the door locking device of FIG. 13 according to various embodiments of the present disclosure.
Figure 18:
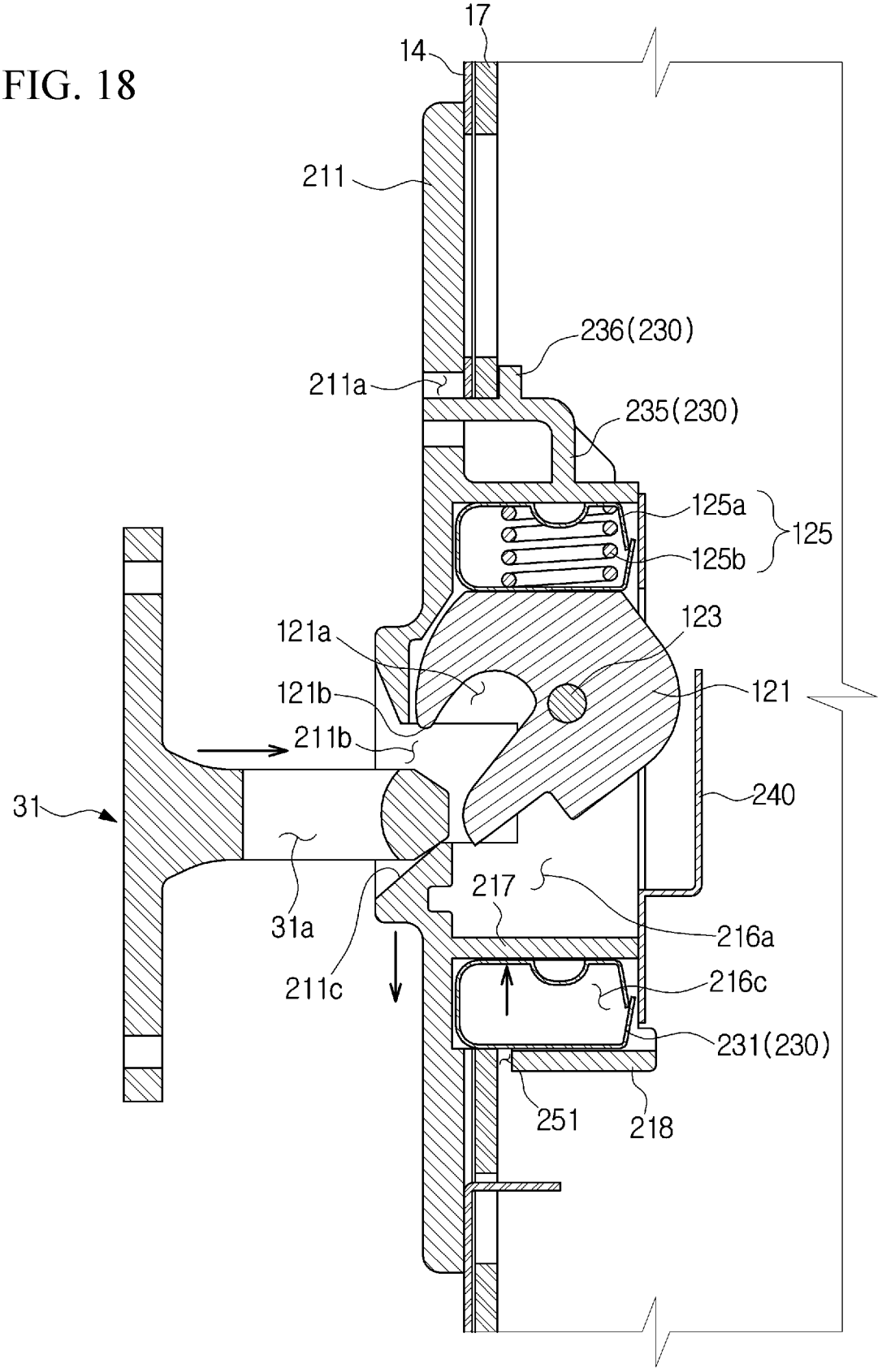
Figure 19:
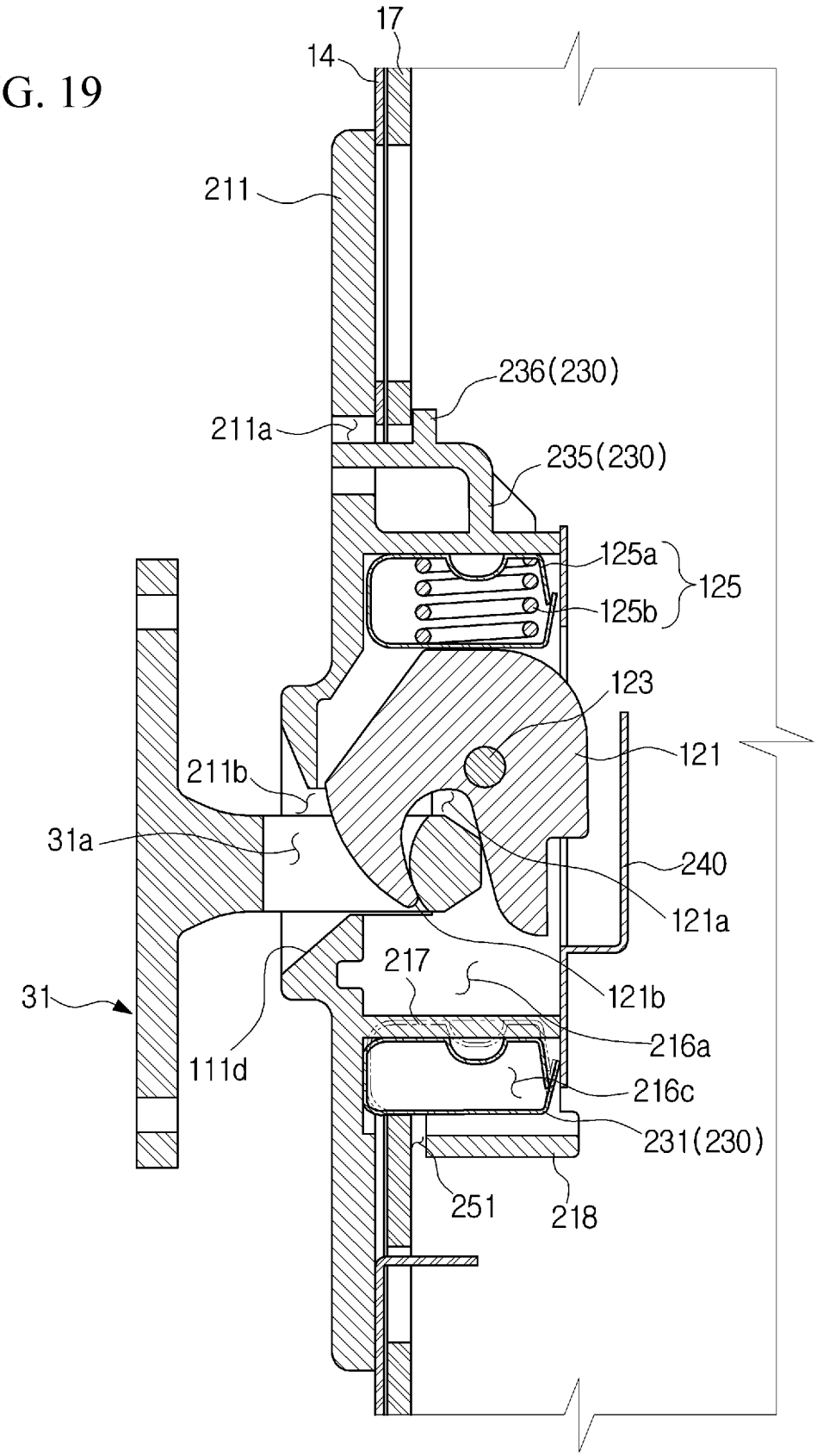

FIGS. 17 to 19 are views illustrating a process in which the door is coupled to the door locking device of FIG. 13.

Referring to FIGS. 17 to 19, the engaging member 31 is located below the insertion hole 211*b* of the door locking device 200 due to the sagging phenomenon of the door 30. Thus, when a user moves the open door 30 to the main body 10, the engaging member 31 is moved toward the door locking device 200 along with the door 30. As illustrated in FIG. 18, the engaging member 31 collides with the guide unit 211*c* formed under the insertion hole 211*b* of the door locking device 200 due to the sagging phenomenon of the door 30.

The door locking device 200 is moved downward due to the collision of the engaging member 31 and the guide unit 211*c*. The restoring spring 231 is compressed by a distance in which the door locking device 200 is moved downward. In this manner, while the engaging member 31 passes through the insertion hole 211*b*, the door locking device 200 is moved downward. Even when the engaging member 31 is partially shifted from the insertion hole 211*b* due to this, the engaging member 31 is coupled to the door locking device 200.

As described above, the restoring spring 231 is provided so that the door locking device 200 can move vertically, similar to the first lever 131 of the door locking device 100 of FIG. 4.

Figure 20:
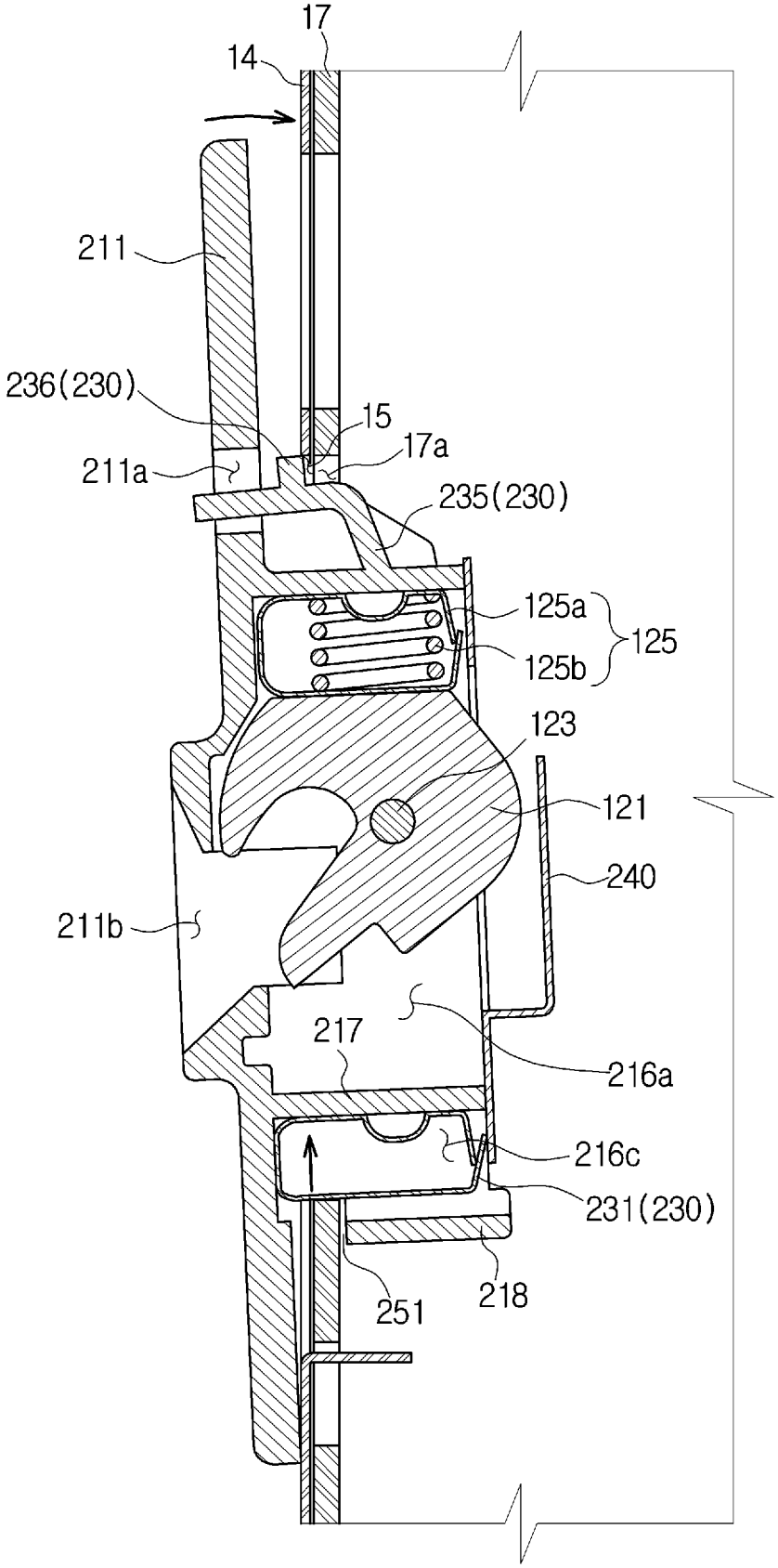
FIGS. 20 and 21 illustrate a process in which the door locking device of FIG. 13 is coupled to a main body according to various embodiments of the present disclosure.
Figure 21:
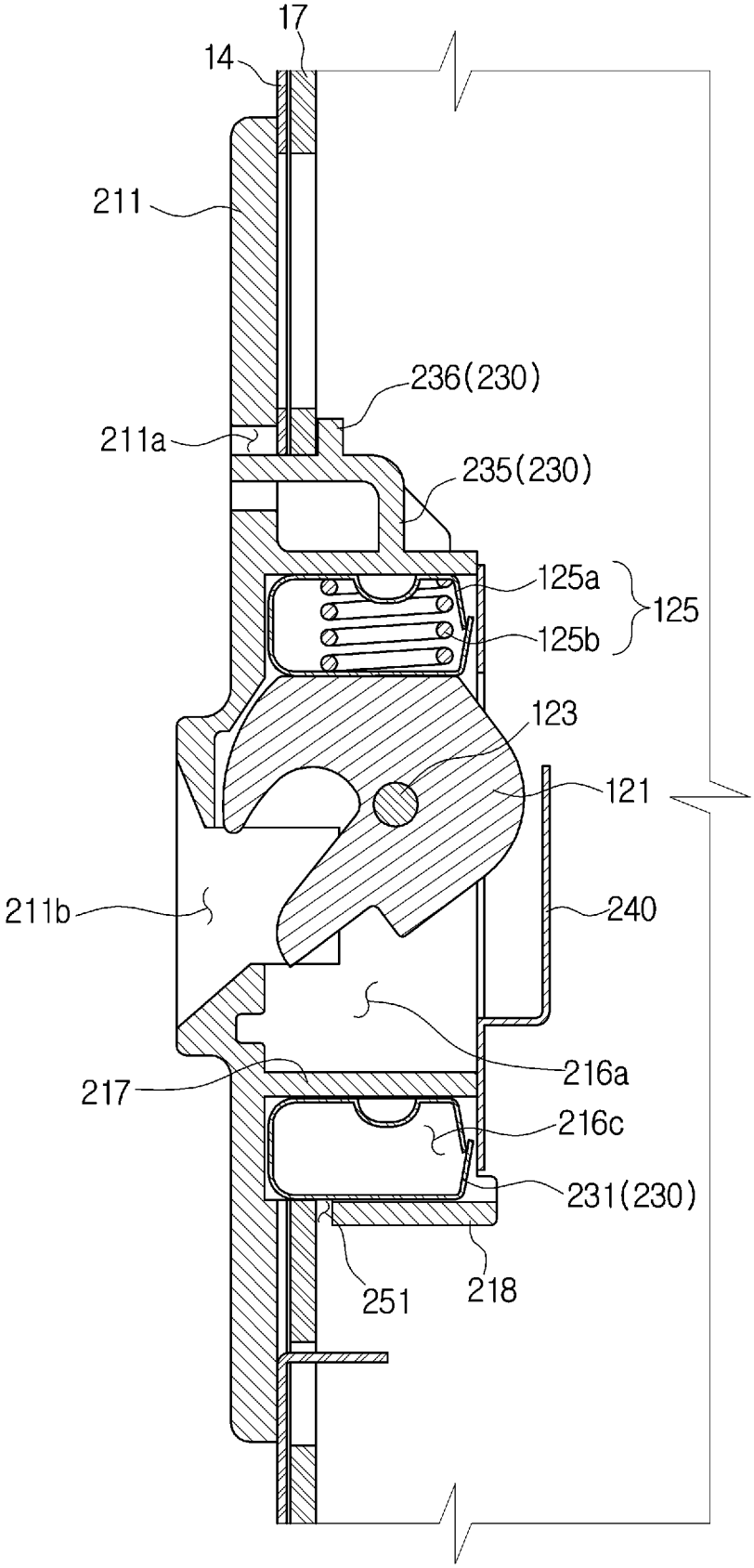

FIGS. 20 and 21 are views illustrating a process in which the door locking device of FIG. 13 is coupled to the main body.

Referring to FIGS. 20 and 21, in order for the door locking device 200 to be coupled to the main body 10, the main body 10 located under the coupling hole 15 is inserted first into the first insertion space 251. Then, in order for the main body 10 located above the coupling hole 15 to be inserted into the second insertion space 252, the door locking device 200 is moved downward while the restoring spring 231 is compressed. Accordingly, the main body 10 located above the coupling hole 15 is easily inserted into the second insertion space 252. On the other hand, the main body 10 may first be inserted into the second insertion space 252 and then the main body 10 is inserted into the first insertion space 251.

The clothing dryer according to the embodiments of the present disclosure can prevent the door and the door locking device from being damaged due to a sagging phenomenon of the door.

The clothing dryer according to the embodiments of the present disclosure includes a door locking device that moves vertically and horizontally while coupled to a main body, and thus the durability of the clothing dryer can be improved.

The clothing dryer according to the embodiments of the present disclosure includes a door locking device that is easily coupled to the main body without screwing, and thus the assembly efficiency can be improved.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A clothing dryer, comprising:

a main body comprising a coupling hole formed in a front surface thereof;

a drying drum installed inside the main body and comprising an opening formed in a front surface thereof;

a door comprising an engaging member provided on a side thereof, and the door is rotatably coupled to the main body and configured to open and close the opening of the drying drum; and a door locking device coupled to the coupling hole, the door locking device is configured to engageably couple with the engaging member when the door closes the opening of the drying drum, wherein the door locking device includes:

a body unit;

a locking unit disposed inside the body unit and from which the engaging member is engageable; and a restoring member, having a restoring force, that protrudes from the body unit and into the coupling hole, and the restoring member is configured to move the door locking device vertically while the door locking device is coupling or separating with the engaging member.

2. The clothing dryer according to claim 1, wherein:

the body unit includes a front plate and a rear case installed at a rear surface of the front plate, and the restoring member includes a first lever configured to extend from a bottom surface of the rear case to the front plate.

3. The clothing dryer according to claim 2, wherein:

the restoring member further includes a first engaging unit configured to protrude downward from a bottom surface of the first lever, and the door locking device further includes a first insertion space provided between the first engaging unit and the front plate, the first insertion space is configured to allow the restoring member to move up or down when the door locking device is inserted into the coupling hole the main body.

4. The clothing dryer according to claim 2, wherein a first hole including a space in which an end of the first lever moves vertically is formed in the front plate.

5. The clothing dryer according to claim 2, wherein the restoring member further includes a second lever configured to extend from an upper surface of the rear case to the front plate.

6. The clothing dryer according to claim 5, wherein:

the restoring member further includes a second engaging unit configured to protrude upward from an upper surface of the second lever, and the door locking device further includes a second insertion space provided between the second engaging unit and the front plate, the second insertion space is configured to allow the restoring member to move up or down when the door locking device is inserted into the coupling hole of the main body.

7. The clothing dryer according to claim 5, wherein a second hole including a space in which an end of the second lever moves vertically is formed in the front plate.

8. The clothing dryer according to claim 2, wherein:

an insertion hole connected to an inside of the rear case is formed in the front plate, and the locking unit is installed at a position facing the insertion hole inside the rear case and includes a locking member comprising an engaging groove from which the engaging member is engageable.

9. The clothing dryer according to claim 1, wherein the body unit includes:

a front plate;

a rear case installed at a rear surface of the front plate; and an insertion space formed by the front plate and the restoring member.

10. The clothing dryer according to claim 9, wherein:

the locking unit is installed at a position facing an insertion hole inside the rear case, and includes a locking member comprising an engaging groove from which the engaging member is engageable, and the insertion space is provided under the locking member.

11. The clothing dryer according to claim 10, wherein the restoring member further includes a third lever configured to extend from an upper surface of the rear case to the front plate.

12. The clothing dryer according to claim 11, wherein a third hole including a space in which an end of the third lever moves vertically is formed in the front plate.

13. The clothing dryer according to claim 10, wherein:

the locking unit further includes a rotating shaft installed inside the rear case, the rotating shaft is configured to rotate the locking member, and the locking member is provided to move horizontally along the rotating shaft inside the rear case.

14. A clothing dryer, comprising:

a main body comprising a coupling hole formed in a front surface thereof;

a drying drum installed inside the main body and comprising an opening formed in a front surface thereof;

a door comprising an engaging member provided on a side thereof, the door is rotatably coupled to the main body and configured to open and close the opening of the drying drum; and a door locking device coupled to the coupling hole, the door locking device is configured to engageably couple with the engaging member when the door closes the opening of the drying drum, wherein the door locking device includes:

a first fixing unit comprising a first insertion space into which a lower end of the coupling hole is inserted; and a second fixing unit comprising a second insertion space into which an upper end of the coupling hole is inserted, and wherein at least one of the first fixing unit and the second fixing unit, having a restoring force, is configured to move the door locking device vertically while the door locking device is coupling or separating with the engaging member.

15. The clothing dryer according to claim 14, wherein:

the door locking device further includes a body unit comprising a front plate and a rear case installed at a rear surface of the front plate, and the first fixing unit includes a first lever configured to extend from a bottom surface of the rear case to the front plate.

16. The clothing dryer according to claim 15, wherein:

the first fixing unit further includes a first engaging unit configured to protrude downward from a bottom surface of the first lever, and the first insertion space is formed between the first engaging unit and the front plate.

17. The clothing dryer according to claim 15, wherein a first hole including a space in which an end of the first lever moves vertically is formed in the front plate.

18. The clothing dryer according to claim 15, wherein the first lever is configured to bend and return to an original position.

19. The clothing dryer according to claim 14, wherein:

the door locking device further includes a body unit comprising a front plate and a rear case that is installed at a rear surface of the front plate, and the first insertion space is formed between the front plate and the first fixing unit.

20. The clothing dryer according to claim 14, wherein the door locking device further includes a body unit comprising a front plate and a rear case installed at a rear surface of the front plate, the second fixing unit further includes:

a third lever configured to extend from an upper surface of the rear case to the front plate; and a third engaging unit configured to protrude upward from an upper surface of the third lever, and the second insertion space is formed between the third engaging unit and the front plate.

* * * * *